United States Patent [19]

Gross

[11] 4,186,642

[45] Feb. 5, 1980

[54] PROGRAMMABLE CIRCUITS FOR ELECTRONIC MUSICAL INSTRUMENTS

[75] Inventor: Glenn Gross, Chicago, Ill.

[73] Assignee: Norlin Industries, Inc., Lincolnwood, Ill.

[21] Appl. No.: 835,695

[22] Filed: Sep. 22, 1977

[51] Int. Cl.[2] ..... G10H 1/02

[52] U.S. Cl. ..... 84/1.24; 84/1.13; 84/1.26; 84/DIG. 8

[58] Field of Search ..... 84/1.01, 1.11, 1.13, 84/1.24, 1.26, 1.27, DIG. 2, DIG. 8, DIG. 23

[56] References Cited

U.S. PATENT DOCUMENTS

| | | | |
|---|---|---|---|
| 3,960,043 | 6/1976 | Brand | 84/1.11 |
| 4,028,978 | 6/1977 | Okamoto | 84/1.26 |
| 4,074,233 | 2/1978 | Swain | 84/1.01 |

*Primary Examiner*—B. Dobeck
*Assistant Examiner*—Leonard W. Pojunas, Jr.
*Attorney, Agent, or Firm*—Ronald J. Kransdorf; Jack Kail

[57] ABSTRACT

A time-shared electronic musical instrument is provided with programmable wave-form generating and tone coloring circuits in order to maintain the musical characteristics regardless of pitch. The circuits comprise programmable keyers and wave-shapers, programmable envelope generators, programmable filters, and a programmable voicing selection circuit, in all of which certain characteristics of the output signal are tailored to the frequency of the musical tone.

72 Claims, 62 Drawing Figures

FIG. 4A
FIG. 4B
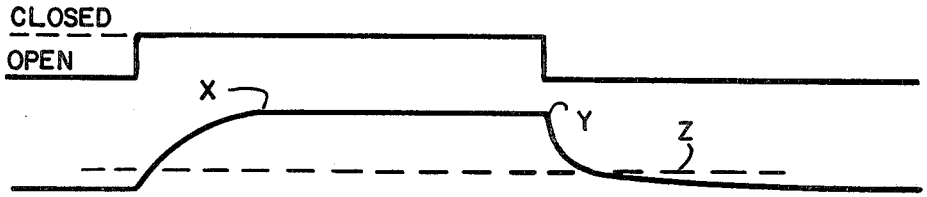
(PRIOR ART)
FIG. 2D
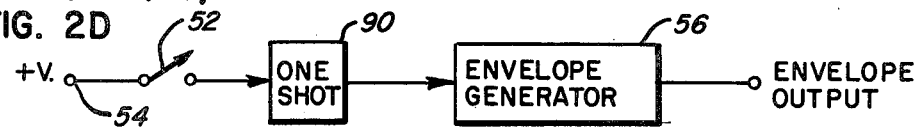
FIG. 5A
FIG. 5B
FIG. 5C
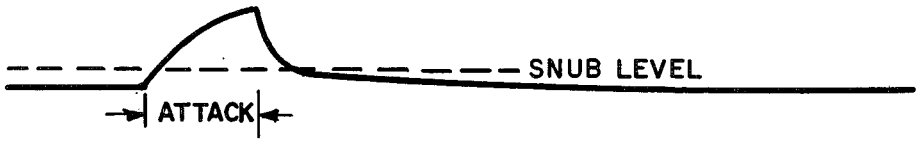
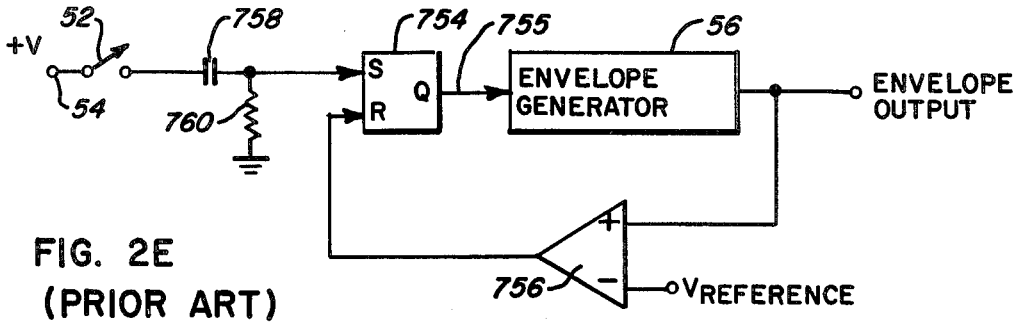
FIG. 2E
(PRIOR ART)

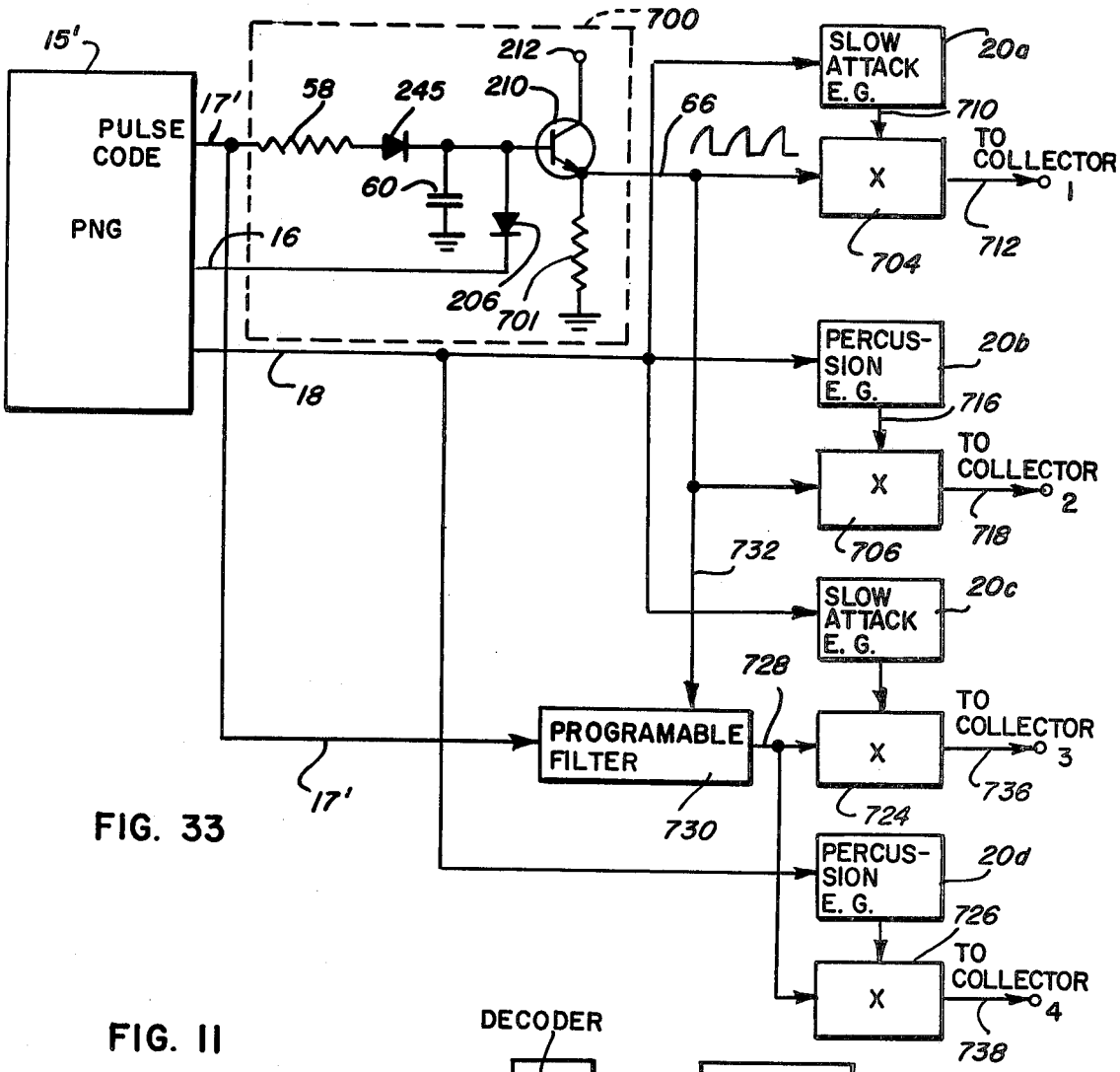
FIG. 33
FIG. 11
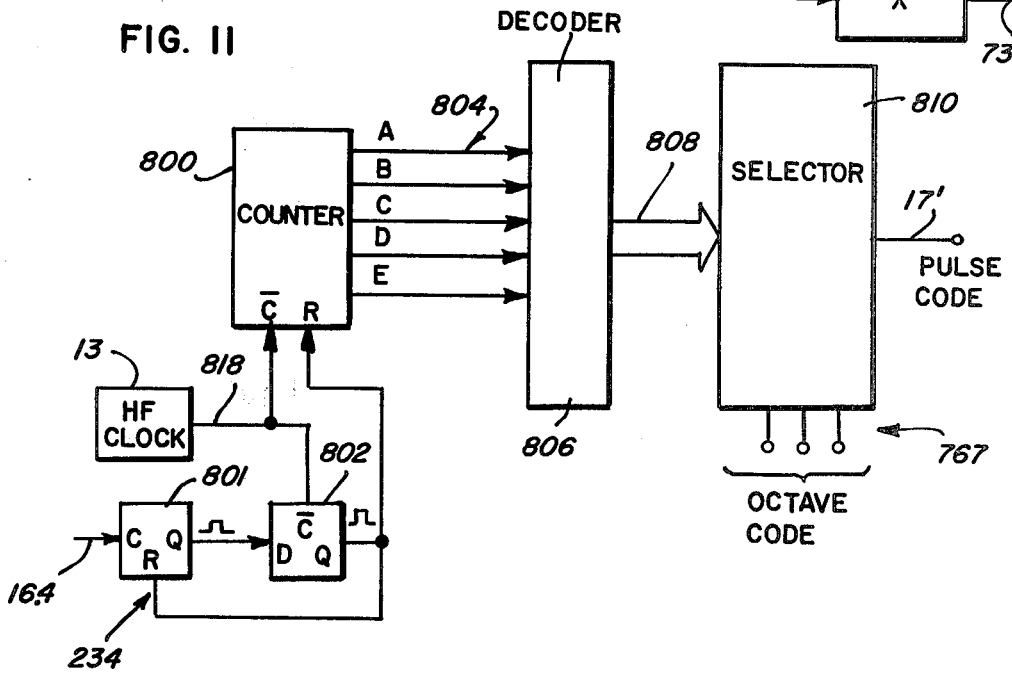

FIG. 17
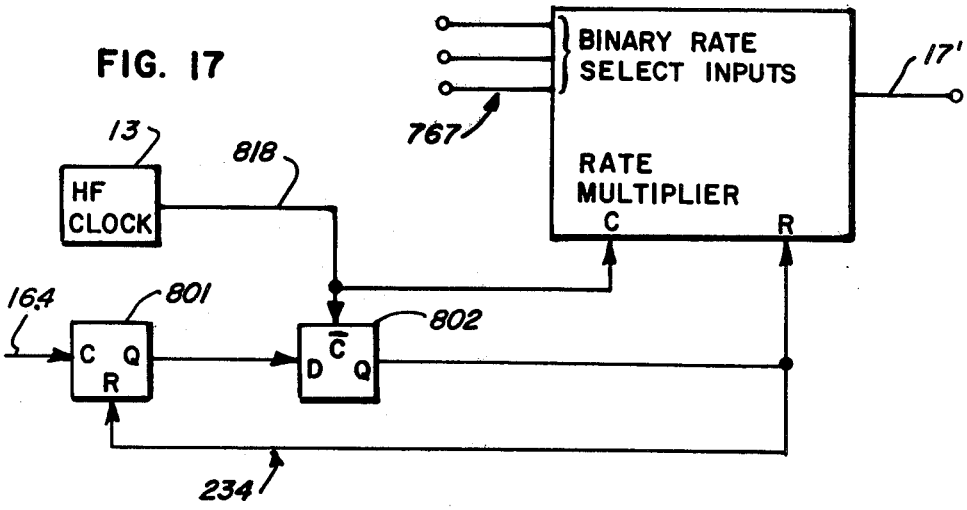
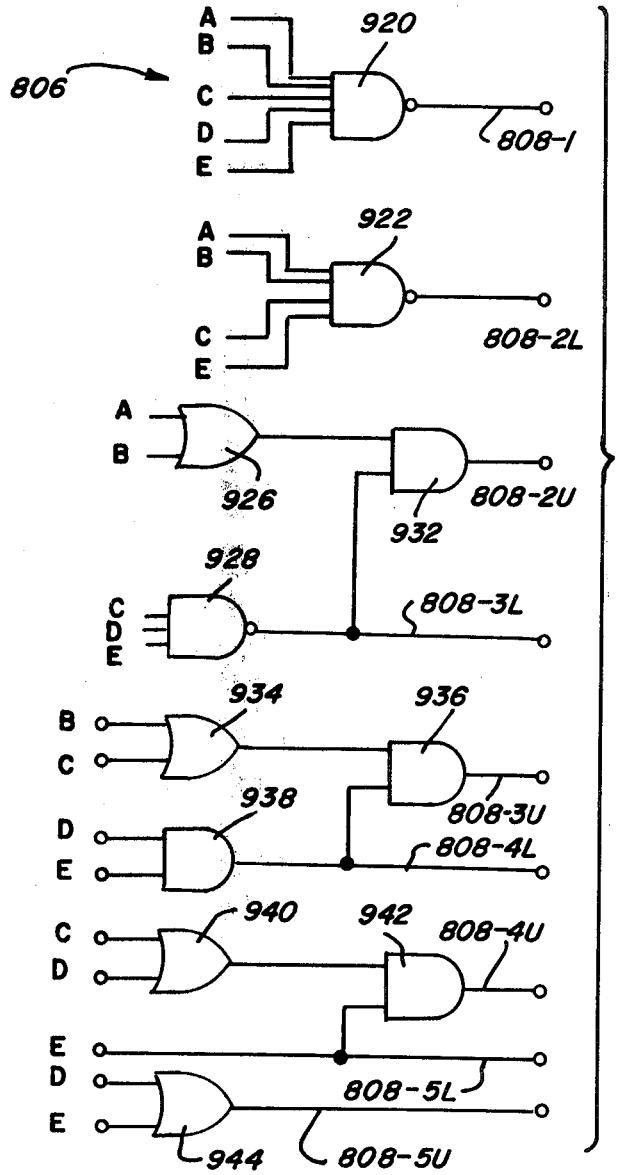
FIG. 12

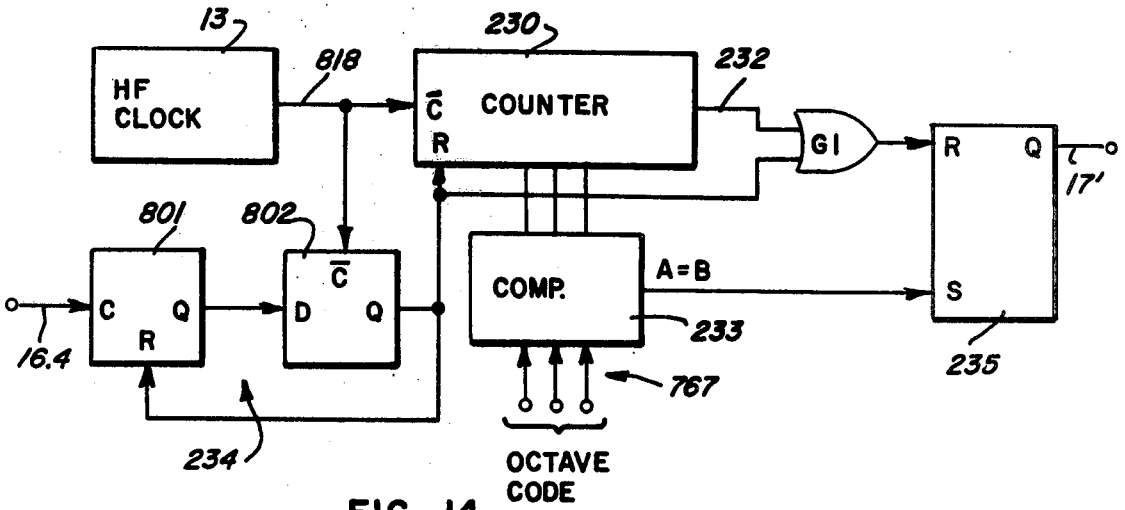
FIG. 14
FIG. 16
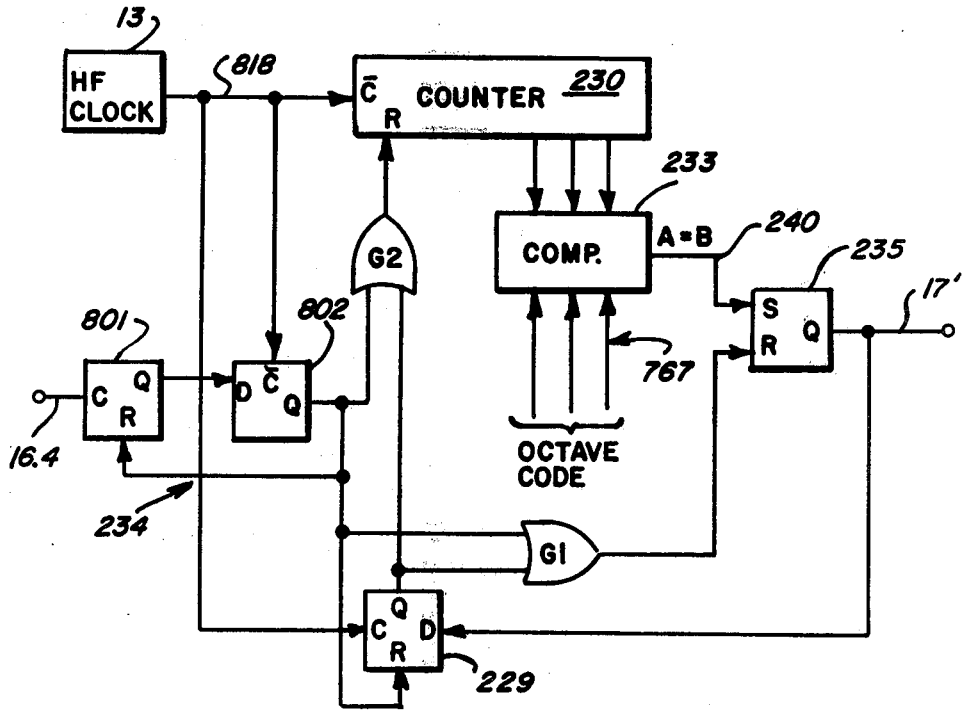

FIG. 30
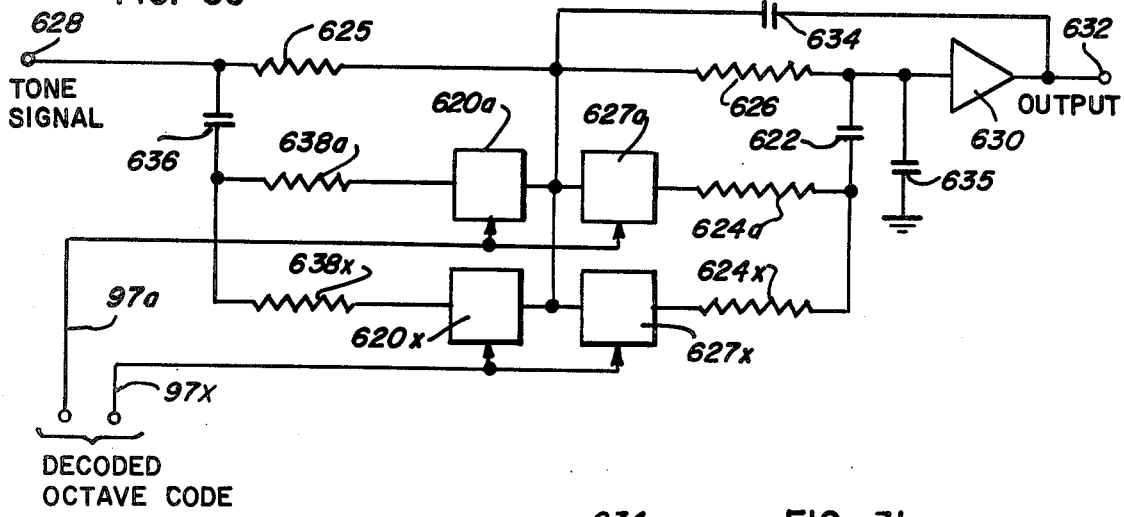
FIG. 31
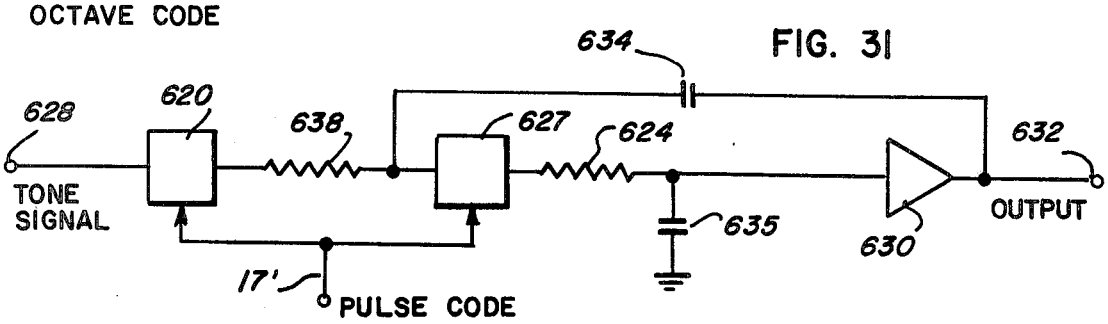
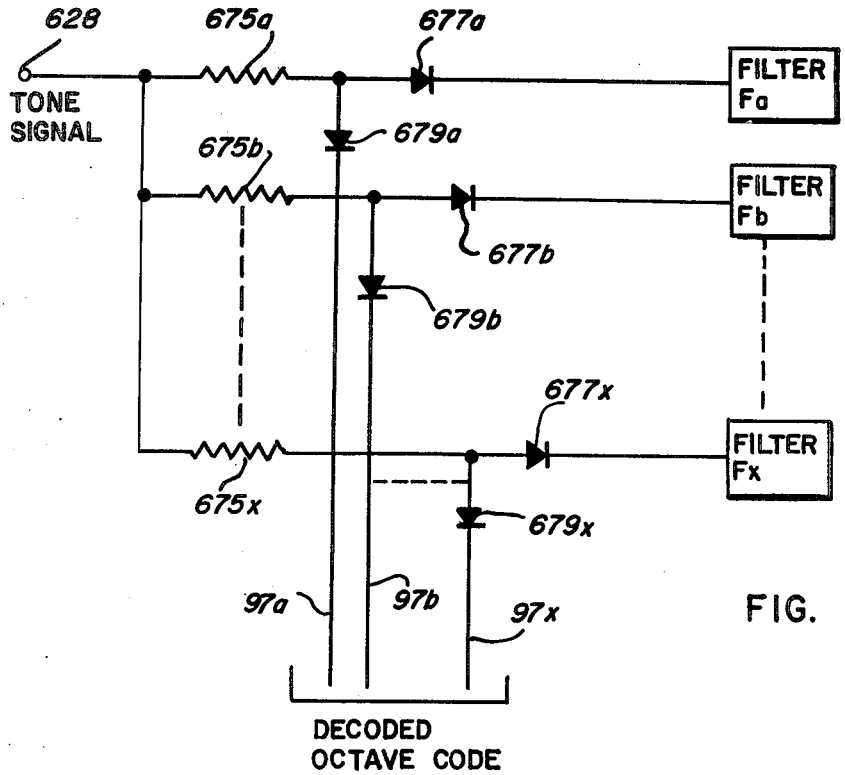
FIG. 32

FIG. 34A
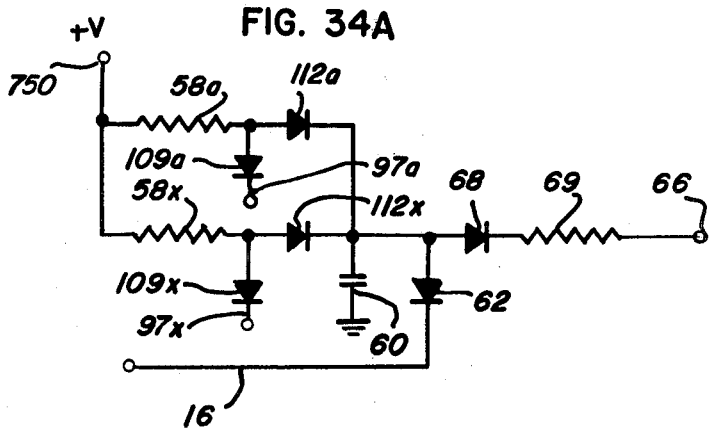
FIG. 34B
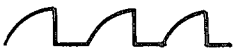
FIG. 35A
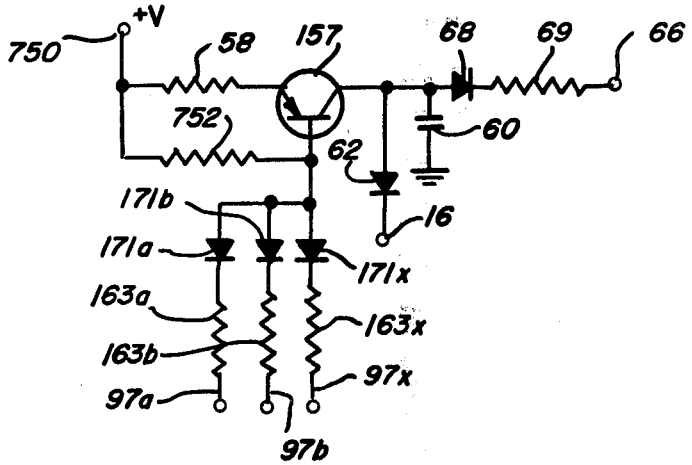
FIG. 35B
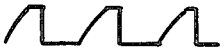
FIG. 36B
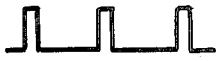
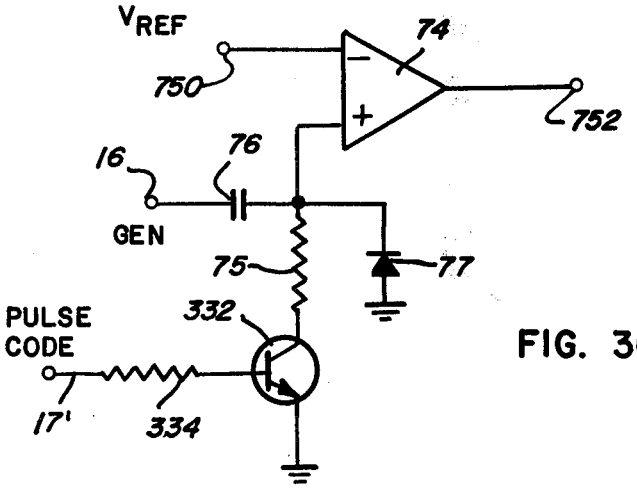
FIG. 36A

PROGRAMMABLE CIRCUITS FOR ELECTRONIC MUSICAL INSTRUMENTS

FIELD OF THE INVENTION

The present invention relates to programmable circuits for electronic musical instruments, the timing characteristics of which can be tailored on demand to suit the audio frequency of the musical note being played.

THE PRIOR ART

In conventional electronic organs a multiplicity of tone generators is required to generate a multiplicity of audio tone signals corresponding to notes of the musical scale over a number of octaves. Keyer circuits, envelope generators and filters are also employed to shape the tone signals before they are passed to an output system, and many such circuits are required to produce a variety of different tones and organ voices. As a result, hundreds of circuits are required in a typical prior art organ. These circuits are each dedicated to respective audio tone signals of particular frequencies, in order that their timing characteristics may be "tuned" to those frequencies.

In a particular type of time-shared electronic organ, a limited number of tone signal generator means are provided, each of which is capable of generating a large number of different audio tone signals. The audio frequency produced by any of the tone signal generators can vary over the entire musical range of the instrument. In some time-shared organs, the required audio output wave-form is produced in the tone signal generator itself, so that other wave-shaping circuits are not needed. This places a limit, however, on the range of voices which can be generated; and, in addition, the apparatus required for producing the wave-shape within the tone signal generator is complicated and expensive. Nor is it practical to use multiple tuned circuits in such a system, because economy of components, the fundamental advantage of the time-shared arrangement, would be lost as a result of the large number of such circuits required to operate over the entire audio frequency range of a musical instrument.

It is therefore desirable to provide programmable keyer, filter and envelope generating circuits for use in a time-shared organ, so that output signals can be tailored to suit the audio frequency of the musical tone signals.

BRIEF DESCRIPTION OF INVENTION

The present invention provides programmable circuits for a time-shared electronic musical instrument in which the wave-shape of the output produced is controlled in a manner which takes into account the frequency of the audio tone signal being played at any given moment.

BRIEF DESCRIPTION OF THE DRAWINGS

Reference will now be made to the accompanying drawings in which:

FIGS. 2A–E illustrate schematic circuit diagrams of prior art keyers and envelope generators;

FIGS. 4A & B illustrate operating wave-forms of an electronic musical instrument key and an envelope generator;

FIGS. 5A–C illustrate operating wave-forms of a percussive envelope generator;

FIG. 11 is a functional block diagram of an alternative form of digital code generator used in a modified form of the priority note generator of FIG. 6;

FIG. 12 is a schematic circuit diagram of a decoder employed in the pulse code generator of FIG. 11;

FIGS. 14 and 16 are functional block diagrams of two additional alternative forms of pulse code generators for use in the modified priority note generator;

FIG. 17 is a functional block diagram of still another alternative form of pulse code generator for use in a modified priority note generator;

FIG. 30 is a schematic circuit diagram of a programmable active filter incorporating the present invention;

FIG. 31 is a schematic diagram of an alternative programmable active filter circuit incorporating the present invention;

FIG. 32 is a schematic circuit diagram of a programmable voicing selection network incorporating the present invention and having a set of fixed filters tuned to different frequencies;

FIG. 33 is a functional block diagram of a system employing a programmable wave-shaper in accordance with this invention together with a plurality of envelope generators of different voicing characteristics for producing audio outputs of different musical timbres; and FIGS. 34A & B, 35A & B, 36A & B comprise schematic diagrams and wave-forms of alternative programmable wave-shaping circuits which may be used in the sytem of FIG. 33.

DESCRIPTION OF THE PRIOR ART

Figure 2A:
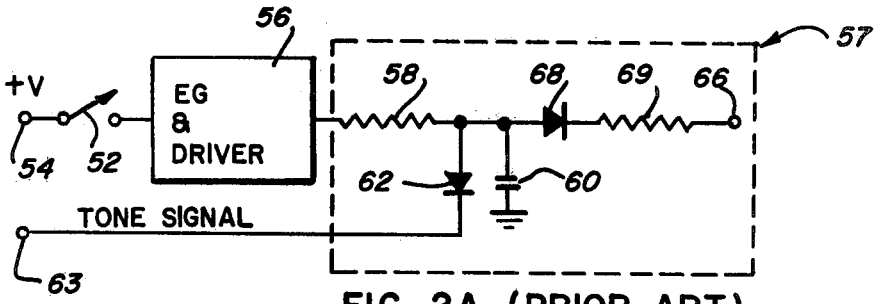
FIG. 2A (PRIOR ART)
Figure 3A:
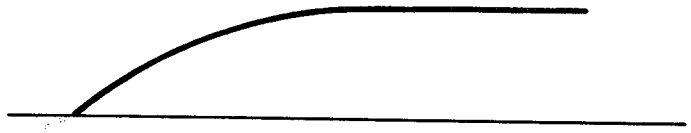
FIGS. 3A–J illustrate several operating wave-forms of various prior art circuits and other circuits in accordance with this invention.

In order best to appreciate the advantages in construction and operating of the present invention, electronic organ circuits of the prior art will first be considered. One such circuit is illustrated in FIG. 2A, which shows in diagrammatic form a key switch 52 of the momentary closure type, which is associated with one key of a musical keyboard. Closing of the switch 52 (by depressing the key with which it is asociated) establishes a conductive path from a voltage source 54 to an envelope generator and driver circuit 56, which then produces an envelope signal (FIG. 3A).

Figure 3B:
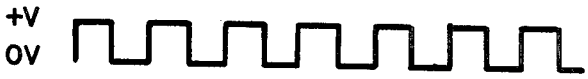

The envelope signal in turn is applied to a keyer 57 which includes an RC circuit incorporating a resistor 58 and a capacitor 60. The junction of the resistor 58 and capacitor 60 is connected through an envelope-chopping diode 62 to a source 63 of a tone signal. The tone signal is typically a rectangular wave (FIG. 3B) having a pulse repetition rate at an audio frequency representing the particular musical note called for by the particular key switch 52. The diode 62 functions to discharge the capacitor 60 during each negative half cycle of the audio tone signal. During the positive half cycles, the diode 62 is blocked, so that the capacitor 60 is charged by the envelope signal applied through the resistor 58. The ungrounded terminal of the capacitor 60 is coupled to an output terminal 66 through a series-connected diode 68 and resistor 69.

Figure 3C:
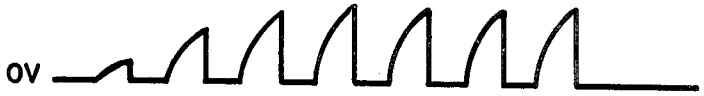

The output of keyer 57 is a wave-form (FIG. 3C) comprising the envelope signal chopped by the musical tone signal into sawtooth-shaped pulses having the same repetition rate as the tone signal. Each individual sawtooth output pulse has a shape determined by the time constant of the keyer's RC circuit 58, 60, including an exponential leading edge and a steep trailing edge. The peak amplitude of each consecutive sawtooth pulse is equal to the instantaneous amplitude of the envelope signal produced by circuit 56.

The rate of rise of each of the pulses in the sawtooth wave-form produced by the keyer circuit 57 is independent of the frequency of the musical tone being played, since the slope of the leading edge of the sawtooth pulse is dependent only on the fixed time constant of the RC network 58, 60. Therefore, one cannot vary the frequency of the musical tone signal on terminal 63 beyond certain limits and still use the same RC values in the keyer circuit 57. Because the values of components 58 and 60 are fixed, the prior art keyer 57 is, in effect, "tuned" for use only with a small range of musical frequencies, much smaller than the entire musical range of an electronic organ.

Figure 2B:
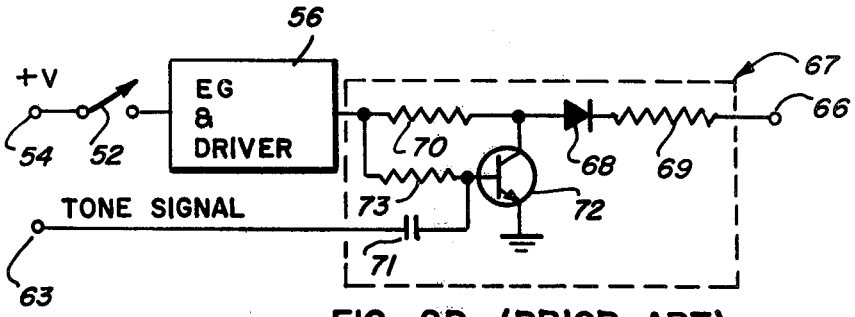
FIG. 2B (PRIOR ART)

FIG. 2B illustrates another prior art keyer 67 which produces an output wave-form (FIG. 3E) in the shape of a pulse train having a pulse width which decreases as the envelope amplitude increases. The two musical output wave-forms (FIGS. 3C and 3E) have different harmonic contents, and thus different musical voices. Either one may be required in a given musical context.

Figure 3D:
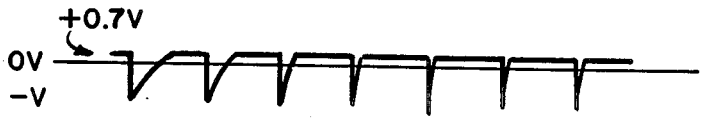
Figure 3E:
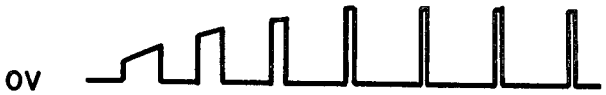

In FIG. 2B, the envelope wave-form (FIG. 3A) of circuit 56 is applied to a base bias resistor 73 and the musical tone signal (FIG. 3B) is applied to a coupling capacitor 71. The junction of these components is connected to the base of an envelope-chopping transistor 72, which has its emitter grounded and its collector coupled to the circuit 56 through a resistor 70. The resulting transistor base drive is depicted in FIG. 3D. The transistor 72 is held normally conducting by the base bias resistor 73, and remains conductive during positive half cycles of the tone signal, shunting the envelope voltage output of circuit 56 to ground. The transistor 72 is cut off, however, during part of each negative half cycle of the tone signal (FIG. 3B), as the negative tone signal voltage is transferred across the capacitor 71, so the full instantaneous envelope voltage is abruptly made available at the output terminal 66 through resistors 70 and 69, and the diode 68. The capacitor 71 discharges through the resistor 73, following the negative-going edge of each tone signal pulse, causing the voltage on the base of the transistor to increase, and eventually to reach a value which causes the transistor 72 to become conductive again, so that the envelope voltage is again shunted to ground.

Because the transistor base bias level communicated through resistor 73 depends on the instantaneous amplitude at the output of circuit 56, the duration of the output pulses produced (FIG. 3E) by circuit 67 decreases with increasing amplitude of the envelope signal (FIG. 3A) produced by circuit 56. But the range over which the output pulse width varies in FIG. 3E depends solely upon the fixed RC time constant of the network 73, 71. Thus, here again, a prior art keyer circuit 67 with fixed values of components 73 and 71 is useful only over too limited a range of audio frequencies.

Figure 2C:
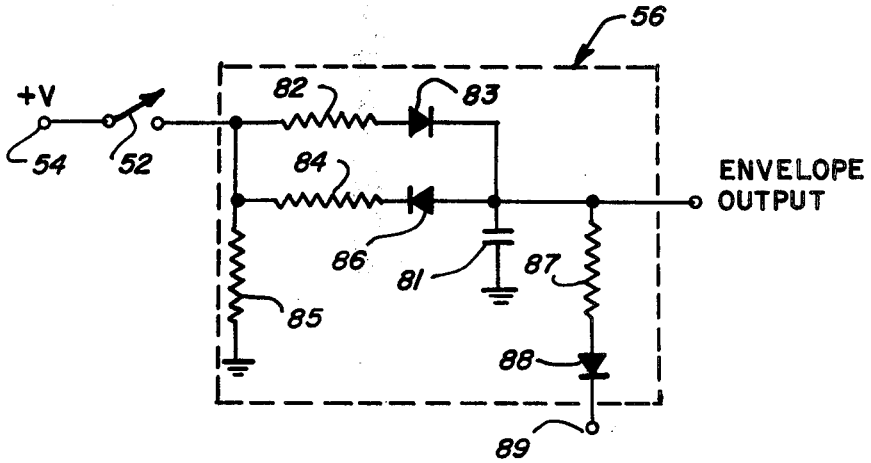
FIG. 2C (PRIOR ART)

FIG. 2C illustrates a conventional arrangement of the circuit 56 for developing an envelope signal in response to closure of a key switch 52. On closing the switch (see the wave-form in FIG. 4A), a capacitor 81 charges through a resistor 82 and a diode 83 toward the level of the voltage on terminal 54. On release of the switch, the capacitor 81 is initially discharged through two discharge paths simultaneously, a first discharge path including resistors 84 and 85 and diode 86, and a second discharge path through resistor 87 and diode 88 to a voltage source connected to terminal 89. But after the capacitor 81 has discharged to the level of the voltage source at terminal 89, further discharge is through the first discharge path 84, 85 only. The resulting output wave-form is shown in FIG. 4B. Note that upon closure of switch 52, the envelope output initially rises exponentially until, at point x, it reaches the level of the input voltage on terminal 54. This leading edge of the wave-form is the "attack" phase of the resulting musical note, and the exponential shape thereof is well adapted for imitating the sound of pipe organs and other non-percussive acoustical instruments. The envelope output remains at this level until point y, when the switch 52 opens to allow an exponential decay at a first rate to voltage level z, the voltage supplied to terminal 89. Thereafter, the exponential decay continues at a slower rate. Level z is known in the art as the "snub" level, and is useful in imitating the sound of certain acoustical instruments.

Note that in envelope generator 56, the fixed RC time constant of components 81, 82 determines the attack wave-shape, and the RC time constants of components 81, 84, 85 and 81, 87 determine the pre-snub and post-snub decay wave-shapes respectively. For the best musical results in some situations, the RC component values chosen for a given envelope generator circuit 56 should only be used over a small range of musical tone frequencies. This is particularly true where the musical instrument is designed to simulate a piano or other percussive sound.

If the musical instrument is to simulate a percussive sound, it is customary to add a one-shot circuit 90 to the circuit ahead of the envelope generator 56, as illustrated in FIG. 2D. The one-shot serves the purpose of turning off the envelope generator even if the key switch 52 remains closed beyond the cycle time of the one-shot. This causes the envelope output to decay promptly in true percussive fashion, without regard to the length of time the player keeps the keys depressed. Thus, the wave-form of FIG. 5A illustrates a closure of key switch 52 which is prolonged beyond the cycle time of the one-shot 90, the latter being illustrated by the much shorter pulse wave-form in FIG. 5B. The resulting output wave-form of envelope generator 56 is illustrated by FIG. 5C, which shows that the envelope is not sustained beyond the termination of the one-shot cycle. As soon as the one-shot pulse (FIG. 5B) terminates, the leading edge of the envelope output (FIG. 5C) is cut off, and is immediately followed by the trailing edge, despite the fact that the key switch 52 remains closed a while longer.

The one-shot circuit 90 can be any conventional monostable multivibrator. It may employ an internal RC timing circuit in the well-known way to determine the one-shot cycle time, in which case the RC timing components must be scaled so that the duration of the leading edge, or "attack" phase, of the percussive envelope (FIG. 5C) is appropriate for the particular musical tone frequency with which the circuit is to be used.

Alternatively, the one-shot and envelope generator combination may employ the configuration of FIG. 2E, in which the key switch 52, through an RC differentiating circuit 758, 760, sets a flip-flop 754, the Q output of which is applied over a line 755 to turn on the envelope generator 56. The early percussive decay is derived by feeding back the envelope output through a comparator 756 to reset the flip-flop 754. The timing components which limit the musical range of this circuit arrangement are the internal RC networks of circuits 754 and 56.

Summarizing the foregoing discussion of the prior art, it has now been shown that various circuits of the type previously used as keyers and as envelope generators of the percussive and non-percussive types in electronic musical instruments have been limited by their fixed RC time constants to use with a particular range of musical tone frequencies. A similar limitation applies to other frequency-tuned circuits, such as filters which are used to achieve various voicing effects in an electronic organ. Consequently, in order to use such circuits for the higher and lower musical tones within the same electronic musical instrument, they have to be provided with different RC component values in order to achieve the shorter and longer time constants which are appropriate to their higher and lower audio frequencies. Therefore, a separate keyer circuit, a separate envelope generator circuit, and a separate set of voicing filters had to be provided for each note within the musical range of the electronic instrument. This multiplication of circuits is wasteful and expensive. It is also completely at odds with the design philosophy of a time-shared circuit such as the musical instrument of the present invention, which is to use the minimum number of circuits, but to multiply the usefulness of each circuit by assigning it as needed on a time-sharing basis.

DESCRIPTION OF THE PREFERRED EMBODIMENTS

In accordance with the present invention, the minimum number of RC-governed circuits is employed in an electronic musical instrument. Even if it is expected that a keyboard instrument is occasionally going to be played by more than one person at a time, nevertheless for musical reasons, the maximum number of keys on the keyboard which would ever need to be depressed simultaneously is ten or twelve. Thus, it is sufficient to provide for any musical contingency in the operation of the instrument, and economical in terms of circuitry and cost, if only ten or twelve musical note-sounding channels are provided. Each such channel, however, by the use of time-sharing techniques described below, can be assigned as needed to sound any note in the entire musical range of the instrument. This, in turn, requires that each circuit in each sounding channel which has timing components, for example, an RC network, must nevertheless be instantly adaptable to the differing timing requirements of any audio frequency, from the lowest to the highest musical note available on the instrument. Such circuits are referred to herein as "programmable".

These programmable circuits need not be programmable to a resolution of a single musical note, however. In practice, any particular choice of timing component values is useable over some range of musical notes, for example, an octave or half octave. Hence, it is only necessary to program each such circuit to a resolution of one or one half octave. In the instrument of this invention, this is accomplished by providing each of the programmable circuits with an instruction signal identifying the particular octave or half octave which contains the particular musical note to be played at any given time. The programmable circuits of this invention are adapted for use in a particular design of a time-shared musical instrument, which is described in co-pending patent application entitled "Tone Generating System for Electronic Musical Instrument", Ser. No. 835,832, filed on Sept. 22, 1977 by Richard S. Swain, et al, and assigned to the assignee of this application. In that instrument, where a small number of note-sounding channels is each capable of sounding any musical note, the octave or half octave signal required by the circuits of the present invention is also necessary for proper assignment of the channels to the appropriate musical notes on a time-sharing basis whenever a key is depressed on the keyboard.

Figure 1:
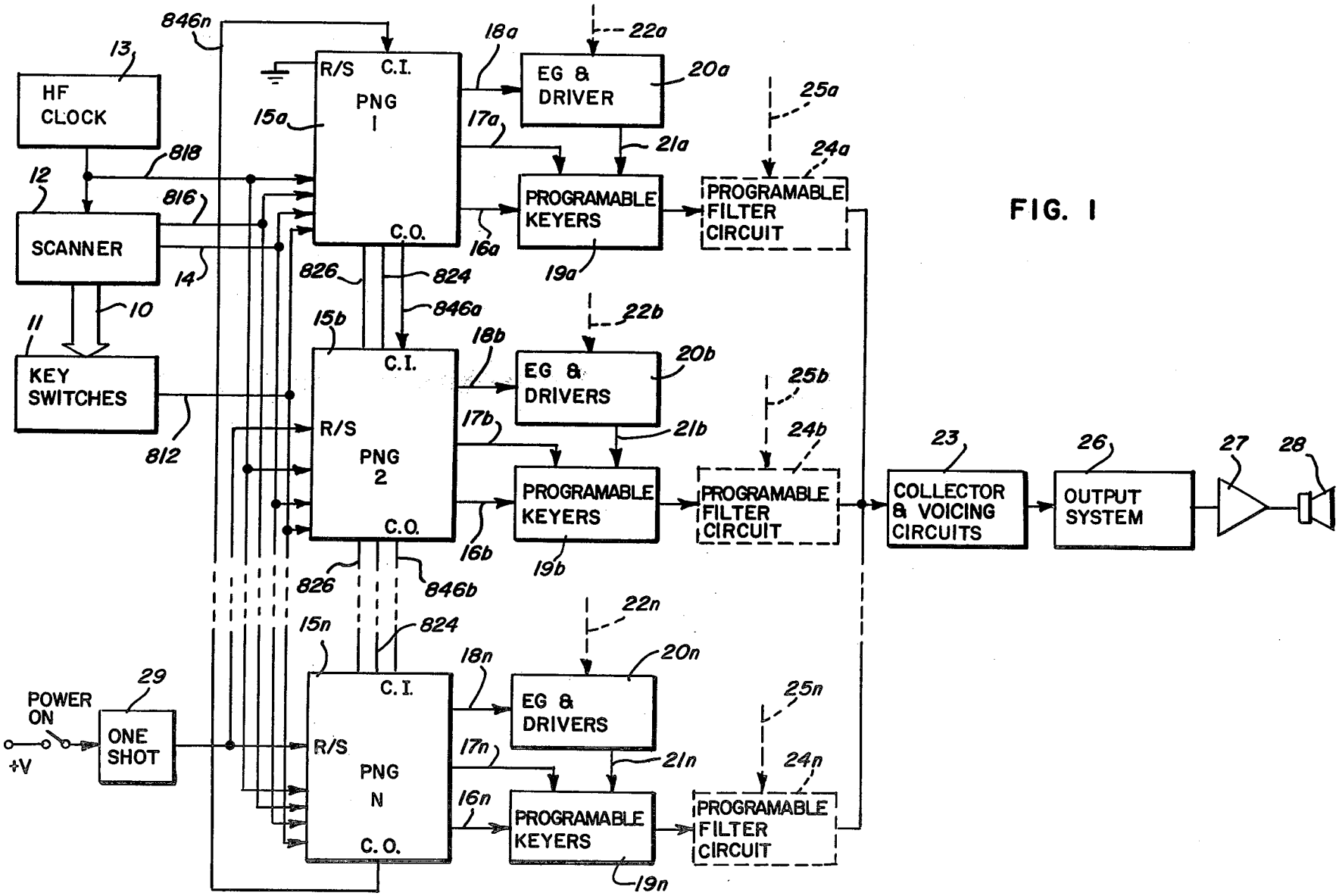
FIG. 1 is a functional block diagram of an electronic musical instrument incorporating programmable circuits constructed in accordance with the present invention.

Referring next to FIG. 1, a time-shared organ having a plurality of programmable circuits is illustrated in functional block diagram form. The instrument comprises a standard keyboard incorporating a plurality of key switches 11. These key switches are identical in all respects with the key switch 52 in FIG. 2, and are associated with respective notes of the musical scale. They key switches are scanned over lines 10 by means of a scanning circuit 12, driven by a high frequency clock generator 13, to produce, on a line 14, a bit serial output signal indicating which of the key switches 11 are closed. Three note-sounding channels are shown in FIG. 1, which are indicated by the subscripts a, b, and n, although ten, twelve or any other desired number may be employed. The note-sounding channels include priority note generators 15, these being activated sequentially on a time-shared basis in response to depression of different keys of the keyboard. Each channel also includes an individual programmable keyer 19, envelope generator and driver circuit 20, and possibly an optional programmable filter 24. All of the note-sounding channels funnel their outputs into a common collector and voicing circuit 23, output system 26, amplifier 27, and loudspeaker 28.

The priority note generators 15*a*, 15*b*...15*n* are all connected to the line 14, and are responsive thereto for producing a plurality of output signals on lines 16, 17 and 18. The signal on each line 16 is a musical tone signal associated with a given depressed key of the musical keyboard. The signal on each line 17 is a digital code representation of the octave or half octave of the depressed key. The signal on each line 18 is a high level which begins when the associated one of the note generators 15 is activated.

Each line 16 is connected to the tone signal input of an associated programmable keyer 19, and the associated line 17 is connected to a control input of the same keyer 19. The line 17 represents, in some embodiments described hereinafter, a plurality of lines which identify the octave or half octave of the selected musical tone signal in bit parallel code, but is shown as a single line in FIG. 1 for the sake of clarity.

The line 18 of each priority note generator 15 is connected to an associated envelope generator and driver circuit 20, which provides the envelope signal for the associated programmable keyer 19. The envelope output signal is delivered to the keyer over a line 21. Optionally, the envelope generator and driver 20 may also be programmed in accordance with this invention, but is not necessarily so in all embodiments of the invention. When it is so controlled, the necessary program control signal comes over a line 22 (shown dashed because it is optional). The source of the signal on line 22 depends upon which of the alternative embodiments of the invention (described below) is chosen.

The outputs of all the programmable keyers 19 are connected to the common unit 23, which includes the collectors and voicing circuits of the instrument. This signal may be so connected directly, or through respective programmable filter circuits 24, programmed by means of signals from the associated lines 25. The units 24 may each contain either a single programmable filter, or a set of fixed filters with a programmable filter selection circuit. Both the circuits 24 and the lines 25 are shown in dashed form because their inclusion in the system is optional.

The output of the unit 23 is connected to a conventional output system 26, the output of which is directed to an amplifier 27 and then to a loudspeaker 28.

Before turning to the programmable circuits of this invention, it will be best to discuss the internal operation of the priority note generators 15, since these provide all the program control signals required by the various programmable circuits 19, 20 and 24 to be described below. The internal circuitry of the priority note generator 15, which is more fully discussed in the co-pending patent application referred to above, is also illustrated here in FIG. 6. Focussing on that drawing and on FIG. 1 as well, it is seen that a synchronizing signal derived from the scanner 12 is applied over a line 816 to reset a four-bit note counter 830 and a three-bit octave counter 832. This occurs at the beginning of each scan cycle of circuit 12. The key switch scan output is connected over line 14 as the count input to note counter 830. When counter 830 reaches a count of twelve, corresponding to all the notes in one octave of the chromatic scale, a signal appears on line 834 which is applied as a count input to octave counter 832, and counter 830 then resets. Counter 832 counts up to the number of octaves in the musical range of the instrument, and then resets. Counters 830 and 832 thus serve to indicate the note and octave being scanned at any given time by circuit 12.

Four output lines from counter 830 and three output lines from counter 832 combine to provide a seven-bit parallel code indicating the note being scanned at the given instant. These lines are connected as the information inputs to a seven-bit storage latch 836, and also as one set of inputs to a comparator circuit 838.

In order to establish the proper initial conditions, a power-on reset signal (available from a one-shot circuit 29) is connected to the R/S input of each of the circuits 15, except for the first one, 15*a*. As to the latter, its R/S input is connected to ground. Thus, when a power-on reset signal appears, inverter I causes AND gate G5 to be conditioned only for circuit 15*a*, so that a flip-flop 842 is set for this circuit; while AND gate G6 is conditioned for each of the other circuits 15*b* through 15*n*, causing the flip-flop 842 in the latter circuits to be reset by a signal on line 840 provided by a power-on reset one-shot circuit 841. In addition, at this same time, the signal on line 840 resets another flip-flop 844 and clears the latch 836 in each of the circuits 15.

When a flip-flop 842 of one of the priority note generators is set, it indicates that the particular priority note generator is the one to be utilized for the next musical note to be played. The Q output line 846 from this flip-flop is connected as one input to AND gates G1 and G2. Flip-flop 844 indicates whether the key of the musical keyboard corresponding to the note currently stored in counters 830 and 832 is activated. The $\overline{Q}$ output line 848 from this flip-flop is connected as one input to gate G1, and its Q output line 850 is connected as one input to gate G2. AND gate G1 produces an output when a bit is detected on keyboard data input line 812 during a scan pulse time, and flip-flop 842 is set (indicating that the particular circuit 15 is the next one to be utilized), and flip-flop 844 is reset (indicating that the particular circuit 15 is not presently being utilized), and certain other conditions are also satisfied. The resulting signal on line 852 is applied to the "store" input of latch 836, causing the note and octave count in counters 830 and 832 to be stored in latch 836.

The signal on line 852 is also applied through an OR gate G3 as the gate input to a gate S3, permitting ground potential to be applied to a control bus 826. The latter potential is applied as the input to the C terminal of the flip-flop 842 in each of the circuits 15. In FIG. 1, it is seen that the potential at the C.O. terminal of each circuit 15 is applied over its line 846*a*, b etc. as the input to the C.I. terminal of the next succeeding circuit 15, the potential at the C.O. terminal of circuit 15*n* being applied over its line 846*n* to the C.I. terminal of circuit 15*a*. Since initially it is circuit 15*a*, the flip-flop 842 of which is set to its Q state, there will be a ground potential applied to the C.I. terminal of circuit 15*a*, and a positive potential on the C.O. output from this circuit will be applied to the C.I. input of circuit 15*b*. Flip-flop 842 has the property that, when ground potential is applied to its negative clock ($\bar{c}$) input, the logic level applied to its D input is transferred to its Q output. Thus, at the end of the scan pulse on line 14, when AND gate G1 is deconditioned, causing the signal on line 852 to terminate, and the potential on control bus 826 returns to a positive level, the ground potential at the D input of flip-flop 842 for circuit 15*a* is transferred to the Q output line 846 of this circuit, deconditioning AND gates G1 and G2; and the positive potential on the D input to flip-flop 842 of circuit 15*b* is transferred to its Q output line 846. This means that circuit 15*b* will be utilized the next time a keyboard pulse appears on line 812.

The seven data output lines from latch 836 are connected as the other set of inputs to comparator circuit 838. Thus, as soon as the contents of the counters 830 and 832 are loaded into latch 836, comparator circuit 838 generates an output on line 854 which is connected as one input to AND gate G4. The other input to this gate is scan line 14. This results in a positive output from an AND gate G4 on line 856, which is connected to the clock input of flip-flop 844. On the positive transition of this signal on line 856, the bit appearing on keyboard data line 812 is applied to the D input of this flip-flop and therefore transferred to its Q output line 850. The resulting positive potential on line 850 is connected as the gate input to a gate S1, permitting a positive potential on line 822 to be applied to the output line 18 which is connected (see FIG. 1) to enable the circuit 20 associated with the circuit 15.

The four note bits of the output from latch 836 are applied to an encoding pitch control ROM 860, the output from which on line 862 is utilized to control a programmable frequency divider 864. The high frequency clock signal on line 818 is applied to the input of frequency divider 864, which may, for example, be made up of nine or ten separate divider stages. The signals on lines 862 control the division in each of these stages. The output from the divider on line 866 is a rectangular wave signal at an audio repetition rate which corresponds to the frequency of the selected musical note in the top octave of the instrument. The signal on line 866 is applied to an octave divider 868, which consists of several divide-by-two stages, the output of which (on lines 870) comprises the signal on line 866 plus the outputs from each of these divider stages. Thus, the signals on lines 866 correspond to the selected note in each of the possible octave locations.

Lines 870 are applied to an octave multiplexer 872. The other input to this multiplexer is the highest three, or octave control, bits from latch 836. The output from multiplex circuit 872 on line 874 is at the frequency appearing on the one of the lines 870 corresponding to the octave of the note played. The signal on line 874 is applied to a pitch divider 876 which consists of two divide-by-two circuits. The outputs from pitch divider circuit 876 on lines 16.4, 16.8 and 16.16 are rectangular waves at the frequency appearing on line 874, the frequency one octave below it, and the frequency two octaves below it respectively. These signals, which represent the four foot, eight foot and sixteen foot organ tones respectively corresponding to a particular key, are applied to the programmable keying circuits 19 (the lines 16.4, 16.8 and 16.16 all correspond to line 16 in FIG. 1). The outputs from latch 836 are also applied through a code converting ROM 884 to the output cable 17, and are likewise made available to the programmable keyers 19 to indicate the octave or half octave of the selected musical note.

Other features of the priority note generator 15, which are fully described in the aforesaid co-pending patent application and need not be dealt with in any detail here, are designed to assure that the note scan and circuit assignment operation sequence is repeated, with the code for succeeding notes being stored in succeeding circuits 15, until a circuit 15 has been selected for each key depressed. Means are also provided for preventing the same note information from being stored in more than one circuit 15. The scan rate is much faster than the attack time on a note, so that even if the number of scan cycles required in order to find an empty circuit 15 equals the total number of such circuits, this will not be audibly detectable.

Figure 7:
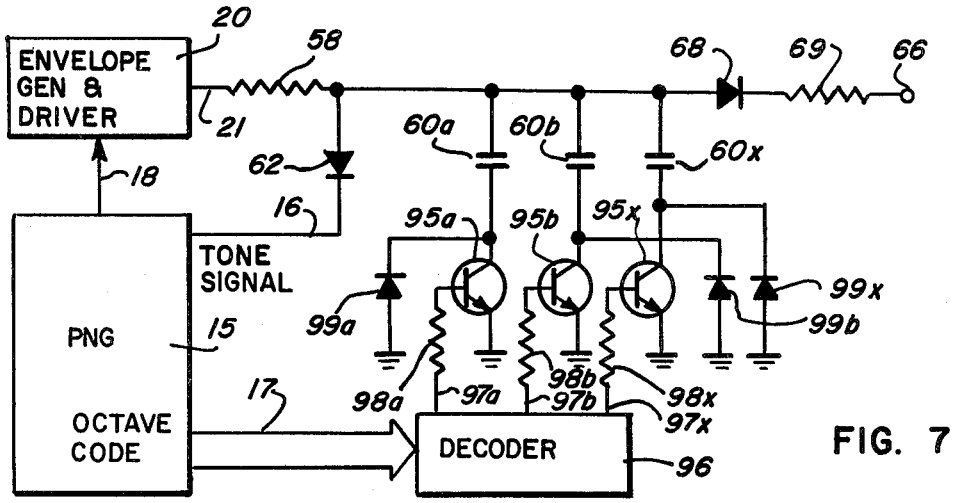
FIG. 7 is a schematic circuit diagram illustrating a programmable keyer incorporating the present invention, in which the capacitance of an RC network is programmed.

Turning now to a description of the programmable circuits of this invention, FIG. 7 shows one arrangement for a programmable keyer 19 for use in the instrument of FIG. 1, which functions, for any given musical tone signal, in the manner described in connection with FIG. 2A.

The envelope generator and driver 20 is associated with an RC network having a resistor 58, and octave selection capacitors 60*a*, 60*b* . . . 60*x*. Only one of the capacitors 60*a*–60*x* is operative at any one time, and during that time its function corresponds to that of capacitor 60 in FIG. 2A. The common connection between the resistor 58 and the capacitors 60 is coupled to output terminal 66 through diode 68 and resistor 69, just as in the arrangement of FIG. 2A. A diode 62 is connected over line 16 to a tone signal, which is a rectangular wave, just as described above. The tone signal comes from one of the priority note generators 15 of FIGS. 1 and 6.

The octave or half octave representation produced by the generator 15 is made available on cable 17, in a binary code having several bits in parallel. The cable 17 is connected to the input of a decoder unit 96, which produces a high logic level output on only one of x output lines 97*a*–97*x*, in accordance with the octave or half octave code. The x outputs 97 are connected respectively through x resistors 98 to the bases of x NPN transistors 95. The collector of each transistor is connected to one of the capacitors 60*1*–60*x*, and the emitters are connected to ground. When one of the transistors 95 is conductive, its capacitor 60 is permitted to be charged by the envelope signal output of the envelope generator 20. The diodes 99*a*, *b*, *x* are for discharging the respective capacitors 60*a, b, x* after the associated transistor 95*a, b* or *x* is cut off. Which capacitor 60 is operative at a given time is thus determined by the octave or half octave of the musical tone connected to the keyer over line 16. The values of the capacitors 60 are scaled to produce an RC circuit having a time constant which is approximately inversely proportional to the audio frequency of the selected musical tone signal. The programmable keyer of FIG. 6 is, therefore, effective to produce output signals having substantially the same amplitude and wave-shape, substantially independently of the frequency of the musical tone signal which is connected thereto.

Figure 6:
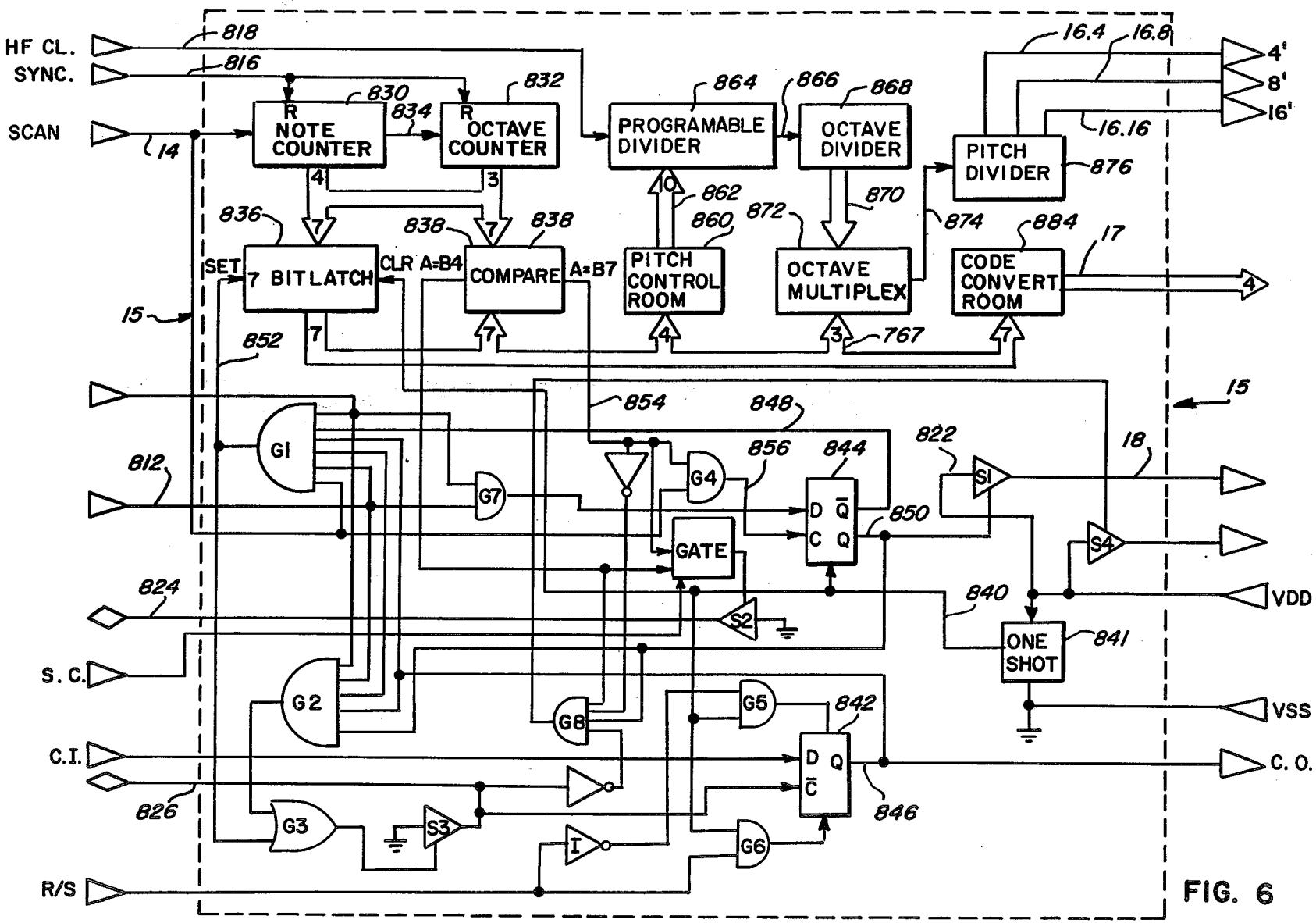
FIG. 6 is a functional block diagram of any one of the priority note generators in FIG. 1.

Three octave selection capacitors 60*a*–60*x* are shown in FIG. 6, but, of course, more would be used in an instrument having a musical range of more than three octaves; and each additional capacitor would have its own transistor 95, resistor 98, diode 99, and decoder connection 97. In one practical arrangement of a six octave instrument, the decoder 96 has at least six output lines 97 connected to six separate transistors 95 associated with six capacitors 92; and if programming is done on an octave and half octave basis, the number would be larger than six. The bipolar transistors 95 may be replaced by J-FET's, MOSFET's, or analog switches, if desired.

Figure 8:
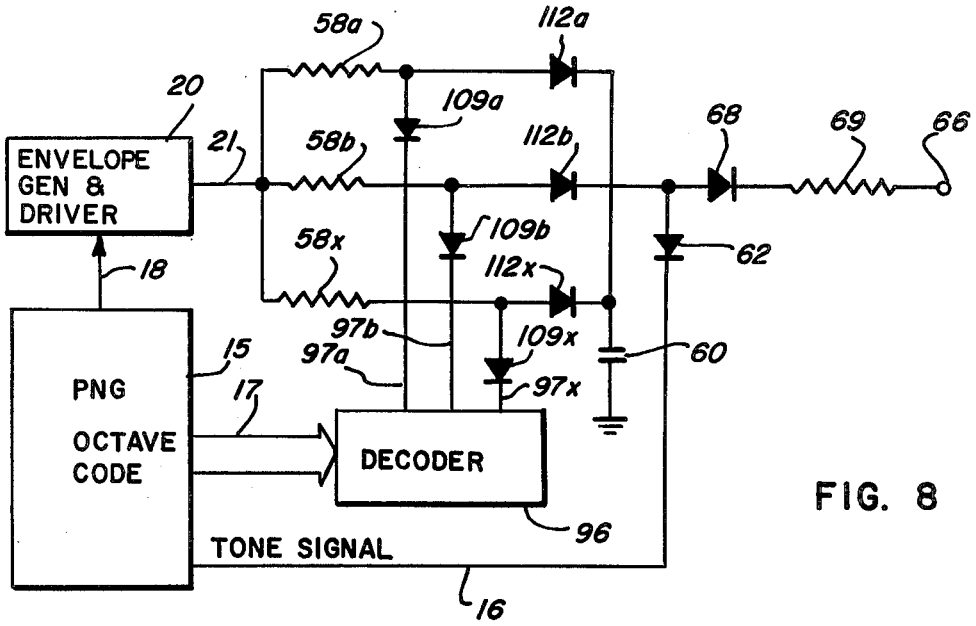
FIG. 8 is a schematic circuit diagram of a programmable keyer incorporating the present invention, in which the resistance of an RC network is programmed.

An alternative arrangement of a programmable keyer 19 is illustrated in FIG. 8. In this circuit, which at any one time also operates similarly to the circuit of FIG. 2A, a single capacitor 60 is employed with one of a number of octave selection resistors 58*a, b* or *x*. One of the three resistors 58*a, b* or *x* is made effective to charge the capacitor 60 by means of the decoder circuit 96. The decoder is responsive to octave or half octave code signals transmitted by the generator 15 over cable 17, so that a relatively high level is produced on one of its x output lines 97, which are connected to respective resistors 58 by respective diodes 109. The high level blocks the particular one of the diodes 109 associated therewith, unclamping its associated resistor and permitting the capacitor 60 to be charged through that resistor 58, to the amplitude of the envelope output signal provided by circuit 20. Additional diodes 112 are provided for isolating the clamped resistors 58 from the capacitor 60. The ungrounded terminal of the capacitor 60 is connected to a tone signal source, by means of a diode 62 and line 16, so that it is discharged during alternate half cycles of the tone signal source. The ungrounded terminal of the capacitor is also connected to output terminal 66 through diode 68 and resistor 69, just as described above.

The circuit of FIG. 8 is thus effective to change the time constant of the RC network of the keyer, by changing the effective value of resistance in the circuit. Series analog switches may replace the series-shunt diode arrangement, if desired.

Figure 9:
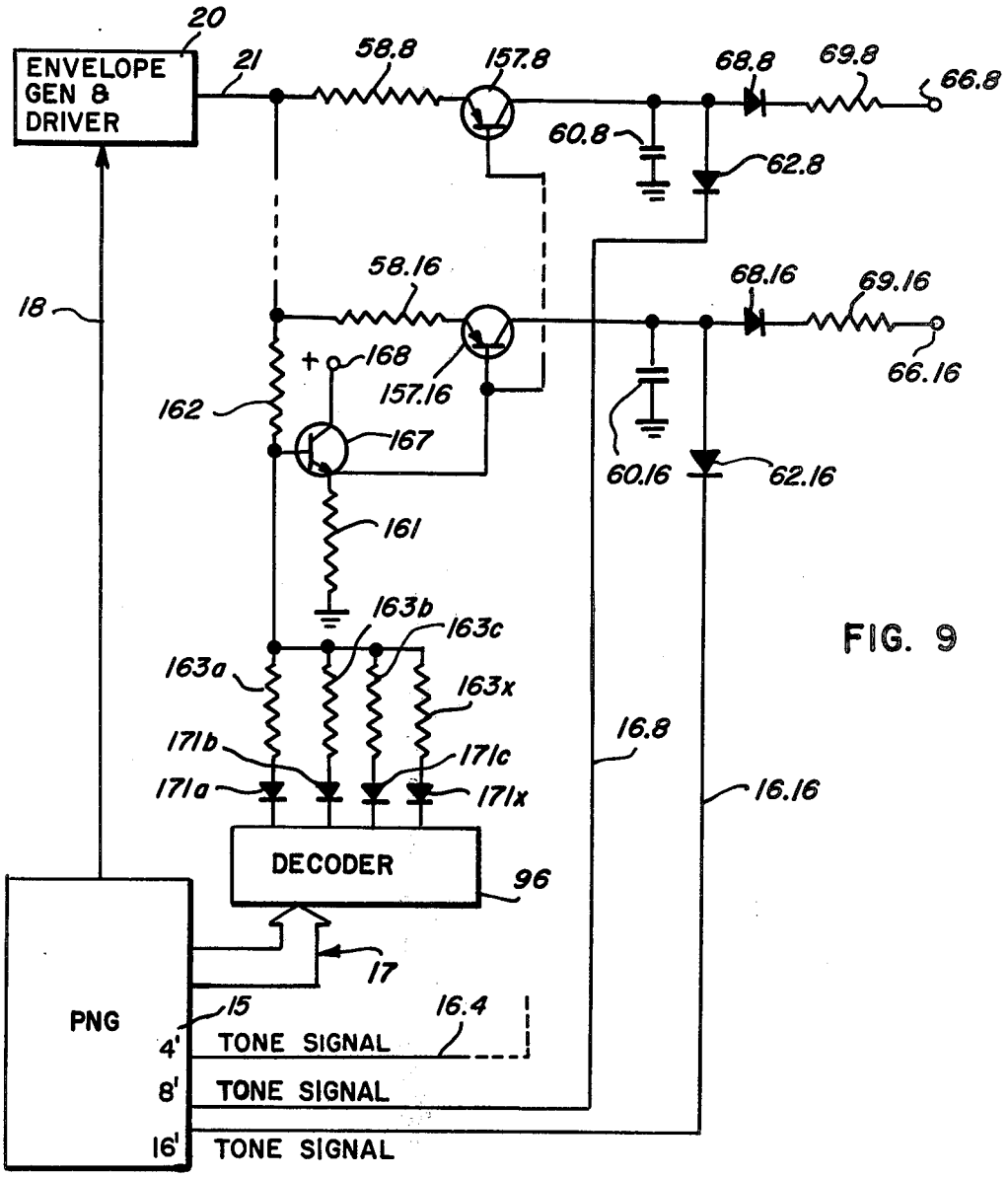
FIG. 9 is a schematic circuit diagram of a programmable keyer incorporating the present invention, in which current input is programmed.

FIG. 9 shows a programmable keyer in which the capacitor of the RC circuit is charged through a transistor which is used to program the charging current. The envelope generator 20 is connected through a resistor 58.8 to the emitter of a charging control transistor 157.8, the collector of which is connected to one terminal of capacitor 60.8, and through a diode 68.8 and a resistor 69.8 to an output terminal 66.8. The other terminal of the capacitor 60.8 is grounded. The resistor 58.8 and the capacitor 60.8 form the time constant RC circuit, just as do the resistor 58 and capacitor 60 in FIG. 2A. A diode 62.8 is provided for connecting the ungrounded terminal of the capacitor 58.8 over line 16.8 to a tone signal developed by the generator 15, in a manner similar to FIG. 2A. The base of the transistor 157.8 is connected to the output of an emitter follower driving stage 167. The envelope generator 20 is connected to a voltage divider circuit formed by a resistor 162 and any one of a plurality of octave selection resistors 163. The output of the voltage divider, available at the junction of resistors 162 and 163, is connected to the base of the driver transistor 167, the collector of which is connected to a source of positive potential at a terminal 168. The emitter of the transistor 167 is coupled to ground through a resistor 161.

In operation, the capacitor 60.8 is discharged, during alternate half cycles of the musical tone signal on line 16.8, through the diode 62.8. During the other half cycles, the capacitor 60.8 is charged by current flowing through the transistor 157.8. The value of this current is determined by the voltage output of the envelope generator 20, and by the output of the voltage divider 162, 163. When the output of the voltage divider is relatively low, the driver transistor 167 conducts relatively little current, so its emitter potential developed across load resistor 161 is relatively low, causing the charging transistor 157.8 to conduct a relatively large amount of current to charge the capacitor 60.8. Conversely, when the output of the voltage divider 162, 163 is relatively high, the driver transistor 167 conducts more current, raising the potential of the emitter of the transistor 167, and limiting the capacitor charging current flowing through the transistor 157.8 to a lower level.

The output of the voltage divider 162, 163 is programmed, as a function of an octave or half octave selection code appearing on cable 17, by selectively blocking or unblocking diodes 171*a*–*x* which are connected in series with respective resistors 163*a*–*x*. Decoder 96 decodes the octave or half octave selection code on cable 17 so that only one of the diodes 171 is unblocked, by applying a low potential signal at the cathode of that diode only, while the other diodes are blocked by high levels at their cathodes. Thus, only one of the resistors 163 is effectively included in the voltage divider circuit. The output of the voltage divider depends on the value of the selected resistor. The resistors 163 are appropriately scaled for octave and/or half octave selection.

The musical tone signal on line 16.8 is the "eight foot" organ tone for a given musical note (see FIG. 6), and all the components associated therewith (identified by reference numerals having the suffix ".8") perform the keying function for the eight foot tone. For each musical note, there are also "four foot" and "sixteen foot" tones octavely related to the eight foot tone; and separate but similar keyer sections are provided to perform the keying function for each of these additional tones. The sixteen foot keyer section is shown in full, but for clarity the four foot keyer section is omitted except for the four foot tone signal line 16.4.

The sixteen foot keyer section comprises an RC timing circuit consisting of a resistor 58.16 and capacitor 60.16. A charging transistor 157.16 is connected between the resistor 58.16 and the capacitor 68.16 to control its charging current, in the way which has been described above in connection with the transistor 157.8. The ungrounded terminal of the capacitor 60.16 is coupled to an output terminal 66.16 through a diode 68.16 and a resistor 69.16, and is also coupled through a diode 62.16 to line 16.16 on which is present the sixteen foot tone signal. Since the latter tone signal has an audio frequency equal to one-half of that of the signal on line 16.8, the time constants of RC network 58.8, 60.8 and RC network 58.16, 60.16 are chosen to have a 2:1 ratio.

Figure 3F:
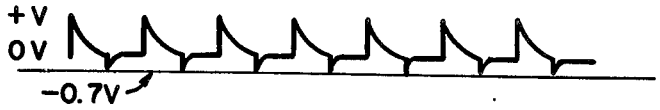
Figure 3G:
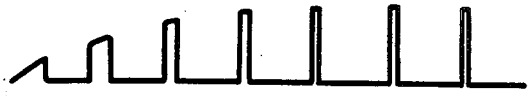
Figure 3H:
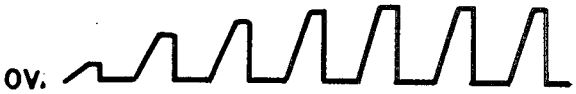

The transistor-controlled capacitor charging circuit of FIG. 9 is especially useful when sawtooth output signals are desired having relatively linear leading edges (see the output wave-form of FIG. 3H). This linearity is produced by the inherent characteristics of the charging control transistors 157.8 and 157.16, which operate essentially as constant current sources.

Figure 10:
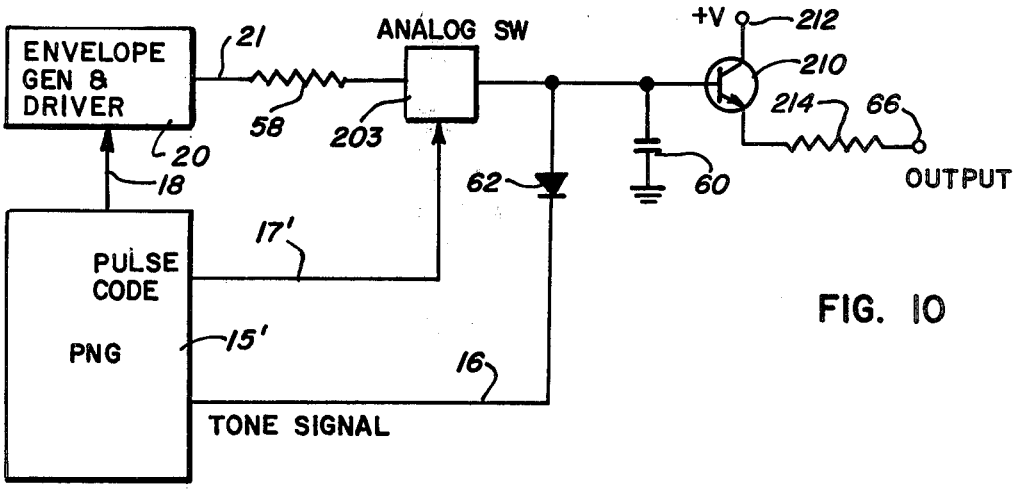
FIG. 10 is a schematic circuit diagram of programmable keyer incorporating the present invention, in which the charging of a capacitor is programmed by a duty-cycle-modulated pulse code technique.

Referring now to FIG. 10, an alternative form of programmable keyer 19 is illustrated, in which the charging rate of the capacitor in the RC timing circuit of the keyer is modified by a variable duty cycle pulse code technique. The envelope generator and driver 20 is connected through resistor 58 to the signal input of an analog switch 203, which may be one section of an integrated circuit commercially marketed by RCA as catalog number CD 4016 (1975 catalog edition). The output of the analog switch 203 is connected to one terminal of capacitor 60, the other terminal of which is grounded. The resistor 58 and capacitor 60 form an RC network, similar to those of the keyers described above. Diode 62 is connected between the ungrounded terminal of the capacitor 60 and a tone signal which is made available by a modified priority note generator 15' on line 16. The ungrounded terminal of the capacitor 60 is also connected to the base of a transistor 210, the collector of which is connected to a source of positive potential at a terminal 212, while its emitter is coupled through a resistor 214 to output terminal 66. The transistor 210 operates to provide an output level at the terminal 66 which is responsive to the voltage across the capacitor 60, without substantially discharging the capacitor.

The control input terminal of the analog switch 203 is connected to a single line 17' to which is applied a train of pulses of controllable width. Such a pulse train is provided, instead of the bit-parallel pulse code on plural lines 17 described above, by the modified version 15' of the priority note generators 15. The duty cycle of the pulses on line 17' controls the average rate of charging of the capacitor 60. If the analog switch 203 is "on" continually, the capacitor 60 charges normally at the rate permitted by the resistor 58. If a square wave is applied to the line 17', the switch 203 is "on" half the time and "off" half the time, with the result that the capacitor 204 requires twice as long to charge up to any given value. If the duty cycle of the pulse train on the line 17' is made shorter, the charging time is even longer.

The wave-form produced at the output terminal 66 (FIG. 31) consists of a train of pulses with leading edges of exponential shape. These leading edges may be made linear, if desired, by replacing the resistor 58 with a constant current device such as the transistors 157 of FIG. 9.

The use of a variable duty cycle pulse train to vary the charging time of a capacitor to produce various musical effects in an electronic organ is not new per se; see U.S. Pat. Nos. 3,924,505 of Schrecongost and 3,415,941 of Brand. But the particular application described here is believed to be novel.

Methods of generating the duty-cycle-modulated pulse code herein are also believed to be novel. The modified circuit 15' is identical to the priority note generators 15 described above, except that it includes means for supplying on line 17' a pulse train the duty cycle of which is a function of the octave or half octave of the selected musical note. It produces both the rectangular wave signal used for the musical tone signal on line 16 and the coded train of pulses on line 17' used for modulating the capacitor charging rate. The pulse repetition rate of the pulses on line 17' is considerably higher than that of the pulses on the line 16, so that the pulse train on line 17' adds a relatively small amplitude of high frequencies into the composite audio output signal. These high frequencies may be eliminated if desired by a simple inexpensive low pass filter, but if the amplitude of the high frequency component is sufficiently small, no special measures need be taken to eliminate it.

FIG. 11 illustrates one of several ways of modifying the priority note generator 15 (FIG. 6) so that it operates as the circuit 15' in FIG. 10, producing the controlled duty cycle pulse train on line 17'. The output of the high frequency clock 13 (FIG. 1) is connected over line 818 to the count input of a counter 800. A reset input is delivered to the counter 800 at the time of the first clock pulse following each pulse present on the fundamental musical tone line 16.4 (FIG. 6), by virtue of the operation of a synchronizer 234 comprising flip-flops 801 and 802. The musical tone pulses are applied to the clock input of toggling flip-flop 801, which then produces a high output level at its Q output. That Q output is connected to the D input of D-type flip-flop 802, the clock input of which is connected to the clock line 818. The Q output of the flip-flop 802 is connected to the reset input of the counter 800, and also to the reset input of the flip-flop 801. Accordingly, the first clock pulse which occurs after the flip-flop 801 is set, sets the flip-flop 802, which immediately resets the flip-flop 801. The flip-flop 802 is reset by the next appearing clock pulse, so that the reset pulse applied to the counter is one clock pulse time in length. The counter 800 produces a binary coded representation of its state on a plurality of output lines 804. The lines 804 are connected to inputs of a decoder 806, which produces, on respective output lines 808, pulse trains of various duty cycles, each one of which is the proper duty cycle for a given program contingency, i.e. for a given selection of musical note and octave. In order to select the appropriate duty cycle, the lines 808 are connected to inputs of a selector unit 810, which has its control terminals connected to the octave code available on lines 767 (see FIG. 6). The selector unit chooses whichever one of the plurality of lines 808 is dictated by the octave or half octave code presented on the lines 767, and passes the pulse train on that line 808 to the outputs line 17' which controls the analog switch 203 in FIG. 10. Thus, the duty cycle of the pulse code on line 17' (and the operation of the analog switch 203 in FIG. 10) are controlled in accordance with the octave or half octave identified by the lines 767.

FIG. 12 is a logic diagram of the decoder 806 of FIG. 11. The decoder comprises a plurality of gates which are effective to decode different combinations of the several outputs A through E of the counter 800 to various ones of the lines 808. The five outputs of the counter 800 identified by the letters A through E are, in order, the least significant to the most significant bit.

A five-input AND gate 920 has all its inputs connected respectively to all five outputs of the counter 800. Its output is connected to a first output line 808-1. The gate 920 produces only a single pulse during each cycle of operation of the counter 800, so that the duty cycle of the pulse train on the line 808-1 is relatively low. It is selected when the octave code on the lines 812 identifies the lowest, or number one, octave for the musical tone signal being generated.

An AND gate 922 has four inputs connected to the counter outputs A, B, C, and E, and its output connected to a line 808-2L. The gate 922 is operative for a greater portion of each cycle of operation of the counter 800 than is the gate 920, so the duty cycle on the line 808-2L is greater than that on the line 808-1. The line 808-2L is selected when the lower half of the second octave is identified by the octave code.

An OR gate 926 is connected to outputs A and B of the counter 800 and produces an output which is connected to one input of an AND gate 932. A three-input AND gate 928 is connected to outputs C, D and E of the counter, and its output is connected to the other input of the gate 932. The output of that gate is connected to a line 808-2U and the output of the gate 928 is connected directly to a line 808-3L. These lines are selected when the octave code identifies respectively the upper half of the second octave or the lower half of the third octave.

An OR gate 934 has its inputs connected to the B and C lines of the counter, and its output connected to one input of an AND gate 936. The other input of the AND gate is connected to the output of another AND gate 938, and two inputs of which are connected to the D and E lines of the counter 800. The output of the gate 936 is connected to the line 808-3U, and the output of the gate 838 is connected to the line 808-4L. These lines 808-3U and 808-4L represent the upper half of the third octave and the lower half of the fourth octave respectively.

An OR gate 940 has its two inputs connected to the C and D outputs of the counter and its output connected to the input of a gate 942. The E output of the counter is connected to the other input of the gate 942. The output of the gate 942 is connected to the line 808-4U, and the E output of the counter is connected directly to the line 808-5L. Two inputs of an OR gate 844 are connected to the D and E outputs of the counter, and its output is connected to the line 808-5U.

The last two characters in the identification of each of the lines 808 identify respectively the number and the half of each octave (L for lower half, and U for upper) of the musical tone signal associated with each of the lines 808.

Figure 13:
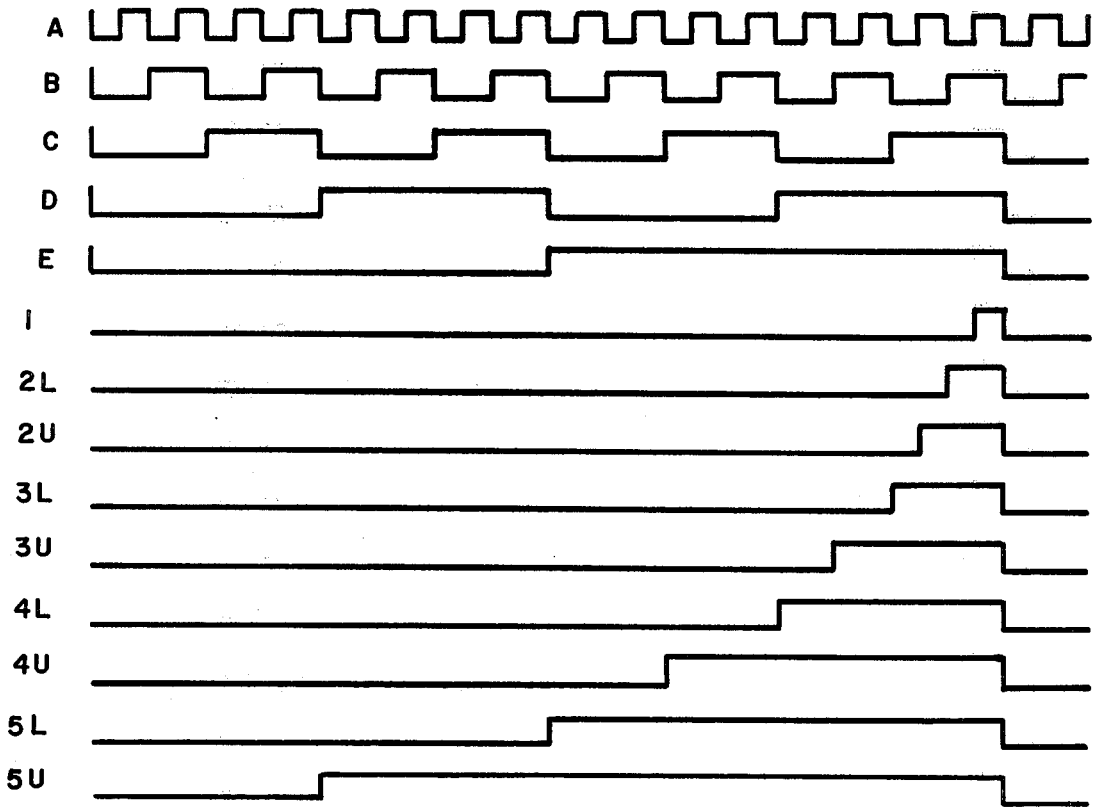
FIG. 13 illustrates wave-forms produced during operation of the apparatus of FIGS. 11 and 12.

FIG. 13 illustrates the wave-forms of the signals which are produced during operation of the apparatus illustrated in FIGS. 11 and 12. Wave-forms A through E of FIG. 13 illustrate the A through E outputs of the counter 800, FIG. 11, which are utilized in the decoder network of FIG. 12. Waveforms 1 through 5U illustrate the output pulse trains produced on the various lines 808-1 through 808-5U by the decoder network illustrated in FIG. 12. It is apparent that the duty cycle of the pulses on the various output lines 808 is dependent upon the decoder logic.

FIGS. 14 and 16 illustrate two alternative ways to modify a priority note generator 15 in order to generate a controllable duty cycle pulse code.

The high frequency clock 13 is again employed in FIG. 14, to generate pulses at a frequency much higher than that required for the pulses on the line 17'. These pulses are supplied by a line 818 to the negative clock input (c̄) of a counter 230. The pules on the line 818 cause the counter 230 to count continually, and overflow pulses are sent over an output line 232 to an OR gate G1 and flip-flop 235. The count in the counter 230 is compared by a comparator 233 to a code presented on input lines 767 (see also FIG. 6), which identifies the octave or half octave of the musical tone signal applied to the line 16 (see FIGS. 1, 10 and 14). A synchronizer unit 234 including flip-flops 801 and 802 connected as in FIG. 11 is employed for resetting the counter 230 and flip-flop 235 (through gate G1) at the time of the leading edge of the music pulse on the line 16.4 to avoid any beating effects in the composite audio output. The synchronizer 234 is not necessary if the repetition rate of the pulses produced by the clock generator 223 is at least seventy times the repetition rate of the musical tone on the line 16.4.

In operation, the counter 230 counts continuously, overflowing each time the full radix of the counter has been reached. If the counter 230 is a four stage binary counter, for example, its radix is sixteen, and an output pulse is produced for every sixteen input pulses. During each cycle of the counter 230, a comparator 233 senses when the content of the counter 230 is equal to the representation of the octave or half octave code on the lines 767, and sets the flip-flop 235, which is reset by the overflow pulse on the line 232 from the counter 230. The Q output of the flip-flop is connected to the variable duty cycle output code line 17', so that the duty cycle of the pulses on output line 17' is dependent on the octave code on the lines 767. If the numerical value of the octave code representation is one, the flip-flop 235 is set by a pulse from the comparator 233 immediately after being reset by a counter overflow pulse, and so the duty cycle of the pulses on the line 17' is high. However, if the numerical value of the octave code representation is fifteen, the flip-flop 235 is not set until relatively late in the cycle of a sixteen-radix counter 230, with the result that the duty cycle is low. Intermediate octave code values give intermediate results.

The wave-forms of FIG. 15 illustrate the operation of FIG. 14. FIG. 15A shows the clock output on the line 818, and FIG. 15B shows the wave-form on the line 17' for a case in which the radix of the counter 230 is eight and a binary six is represented by the code on lines 767. FIG. 15C shows the wave-form on the line 17' under the same circumstances except that a binary five is present on the lines 767. FIG. 15D represents one half cycle of the musical tone signal on the line 16.4, and shows, together with FIGS. 15A–15C, that the counter 230 is reset by the first negative-going half cycle of clock 13 following the leading edge of a musical tone signal positive-going half cycle. FIG. 15E shows the counter reset pulse issuing from the flip-flop 802.

The pulse code generators of FIGS. 11 and 14 are similar to the extent that they both produce an output in which pulse width is modulated, while the repetition rate remains constant at one pulse per cycle of the counter 800 or 230.

There are other ways of coding the duty cycle of the pulse train. For example, FIG. 16 shows another arrangement for producing a series of pulses on the line 17', which have a constant pulse width but a varying repetition rate proportioned to the frequency of a musical tone signal on the line 16.4. In this arrangement, the counter 230 is reset before it is permitted to count to its full radix.

Just as in the arrangement of FIG. 14, a synchronizer 234, including flip-flops 801 and 802, is employed. The Q output of the flip-flop 802 is connected to an input of an OR gate G2. The other input of the OR gate is connected to the Q output of a D-type flip-flop 229. In operation, the counter 230 of FIG. 16 counts upwardly from zero until a comparison is reached with the combination of signals present on the lines 767, at which point the comparator 233 produces a signal on the line 240. The latter is connected to the set input of toggle flip-flop 235, so that the flip-flop is set at the time of the pulse on the line 240. The Q output of the flip-flop is connected to the output line 17', and also to the D input of the flip-flop 229. The clock input of the flip-flop 229 is connected to the high frequency clock 13, so the next clock pulse after the flip-flop 235 is set, sets the flip-flop 229.

The Q output of the flip-flop 229 is connected through OR gate G2 to reset the counter 230, and is also connected through OR gate G1 to the reset input of the flip-flop 235. Accordingly, each pulse on the line 17' lasts for a single clock time of the high frequency clock signal. The flip-flop 229 is reset on the next clock pulse, in order to start another cycle of operation. The counter 230 and the flip-flop 235 are also reset by the first clock pulse following the setting of the flip-flop 801, to maintain synchronization with the musical tone signal on line 16.4.

Figure 15A:
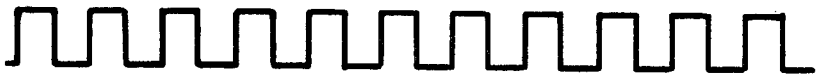
FIGS. 15A–H show various wave-forms associated with operation of the circuits of FIGS. 14 and 16.

The operation of the circuit of FIG. 16 is shown by the wave-forms in FIGS. 15A and F through H. FIG. 15A shows the clock pulses. FIG. 15F shows the output pulses on the line 17' from the Q output of the flip-flop 235 for a condition in which a pulse is produced on the line 240 for each four pulses applied to the counter 230 (i.e. the lines 767 represent a binary three). FIG. 15G shows the reset pulse delivered by the Q output of flip-flop 229 following each pulse in wave-form 15F. FIG. 15H shows the output pulse train on the line 17' for a condition in which a pulse is produced for each two pulses applied to the counter 230. When a larger binary number is represented by the lines 767, the pulses are spaced further apart, giving a lower duty cycle.

Figure 15B:
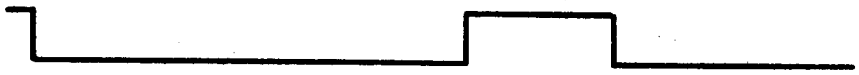
Figure 15C:
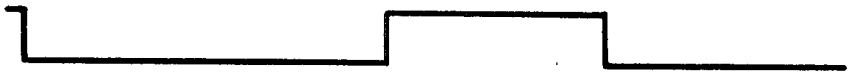
Figure 15D:
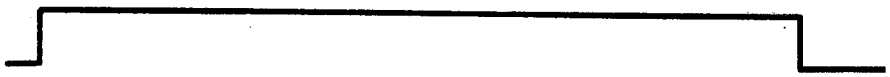
Figure 15E:
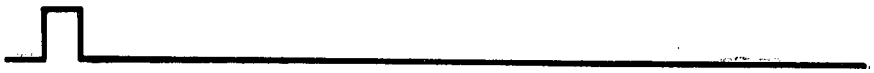
Figure 15F:
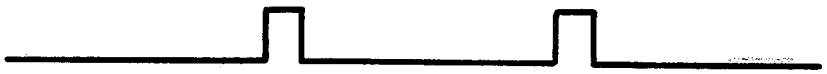
Figure 15G:
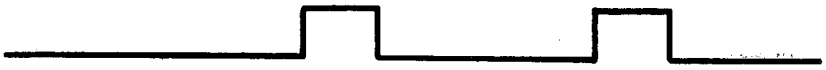
Figure 15H:
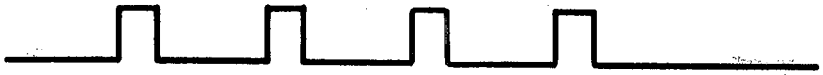

The decoding logic of circuit 806 in FIG. 12, used in the pulse code generator of FIG. 11, can be modified so that the latter circuit produces the same type of output as the circuit of FIG. 16, i.e. a repetition-rate-modulated pulse train as in FIGS. 15G and H rather than one which is width-modulated as in FIG. 13 or FIGS. 15B and C. Rather than reproduce here the modified decoding logic required by circuit 806 (FIG. 11) to effect such a change, it suffices to say that such decoding logic is the same as that incorporated in a standard integrated circuit, known as a rate multiplier, which is designed to produce precisely the desired constant-width, repetition-rate-modulated pulse code output. An example of a commercially available rate multiplier of this kind is RCA's integrated circuit CD4089 (1975 catalog edition). FIG. 17 shows such a rate multiplier connected to operate as an alternative pulse code generator for use in a modified priority note generator 15'. The fundamental musical tone pulses (see FIG. 6) come in over line 16.4 and are supplied to the synchronizer consisting of flip-flops 801 and 802. The output of the high frequency clock 13 (see also FIG. 1) is applied to the count input of the rate multiplier and also to the clock input of the D-type flip-flop 802. The Q output of the latter is connected to the reset input of the rate multiplier. The octave or half octave code on lines 767 (FIG. 6) is applied to the binary rate select inputs of the rate multiplier. The resulting pulse code appearing on output line 17' is the same as that seen in FIGS. 15F and H. The arrangement shown in FIG. 17, which employs a single rate multiplier circuit, can handle only a limited number of octaves in the context of the present invention, but such rate multiplier circuits can be cascaded (according to the manufacturer's instructions) to handle a greater number of octaves.

Figure 18:
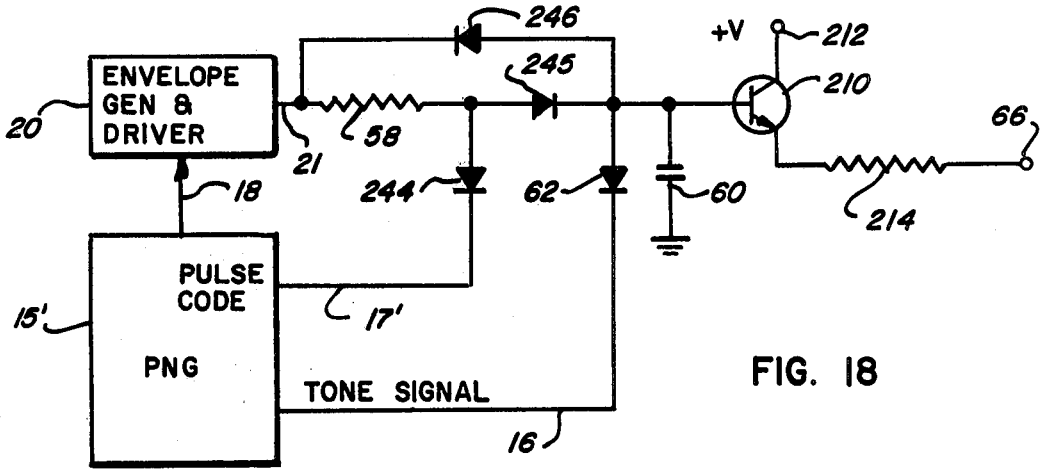
FIG. 18 is a schematic circuit diagram of a programmable keyer incorporating the present invention, in which the charging of a capacitor is also controlled by a duty-cycle-modulated pulse code.

Returning now to our discussion of the various programmable keyer circuits 19 of this invention, the circuit of FIG. 18 is similar to that of FIG. 10, except that a switching circuit, employing series and shunt diodes, is used in place of the analog switch 203.

The resistor 58 and the capacitor 60 form an RC time constant circuit for producing an exponentially rising voltage across the capacitor 60. When the musical tone signal on the line 16 is in its negative half cycle, the capacitor 60 is discharged through the diode 62. When the tone signal is in its positive half cycle, the diode 62 is back-biased and the capacitor 60 is charged through the resistor 58 and a diode 245. This can occur, however, only when a relatively positive potential is present on the variable duty cycle pulse code line 17', back-biasing diode 244, connected to the junction of the resistor 58 and the diode 245. When the voltage on the pulse code line 17' is low, one end of the resistor 58 is clamped to a low level, so that the capacitor 60 may not be charged. It is not discharged, however, because of the diode 245. Accordingly, the average charging rate of the capacitor 60 depends on the duty cycle of the pulse code present on the line 17'.

A diode 246 is connected directly from the ungrounded end of the capacitor 60 to the envelope generator 20, with its polarity opposite that of the diode 245. Residual charge on the capacitor 60 is leaked back to the envelope generator 20 during a period in which the amplitude of the envelope is allowed to decrease, so that the capacitor 60 is maintained in discharged condition when no envelope signal is present.

Figure 19:
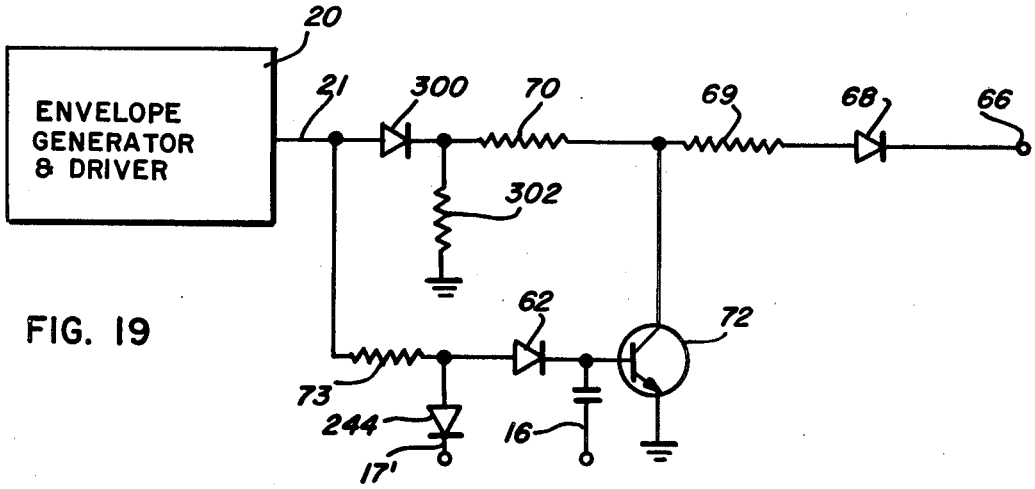
FIG. 19 is a schematic circuit diagram of another form of programmable keyer incorporating the present invention, also programmed by a duty cycle code.

FIG. 19 illustrates the circuit of a keyer 19 for use in the instrument of FIG. 1, which in terms of circuit operation is a programmable version of the prior art keyer circuit seen in FIG. 2B, and in which the programming is done by means of the duty cycle code technique.

The envelope generator and driver circuit 20 applies its envelope output over a line 21 to a coupling diode 300, a resistor 70 and then to the resistor 69, diode 68 and output terminal 66 in turn. A resistor 302, connected between ground and the junction of diode 245 with resistor 70, establishes the cathode voltage of diode 300 at the proper level so that the diode 300 becomes back-biased at the proper time in relation to two other diodes, 62 and 244. The musical tone signal on line 16 is coupled by capacitor 71 to the base of the envelope chopping transistor 72. When positive half cycles of the tone signal drive transistor 72 into conduction, the latter shunts the envelope signal to ground, thus chopping it at a rate equal to the musical tone frequency. During negative half cycles of the musical tone signal, the capacitor 71 discharges through diode 62 and resistor 73. The resistor 73 and capacitor 71, as in FIG. 2C, form the RC network which determines the rate of such discharge, and which in FIG. 19 is programmed in accordance with the invention. The necessary program control pulse code is applied over line 17' and coupled through diode 244 to back-bias diode 62 and thus divert the current of resistor 73 away from the capacitor 71 during negative phases of the pulse code. How much current is diverted depends on the pulse code duty cycle, which in turn is controlled in the manner previously explained.

Figure 20:
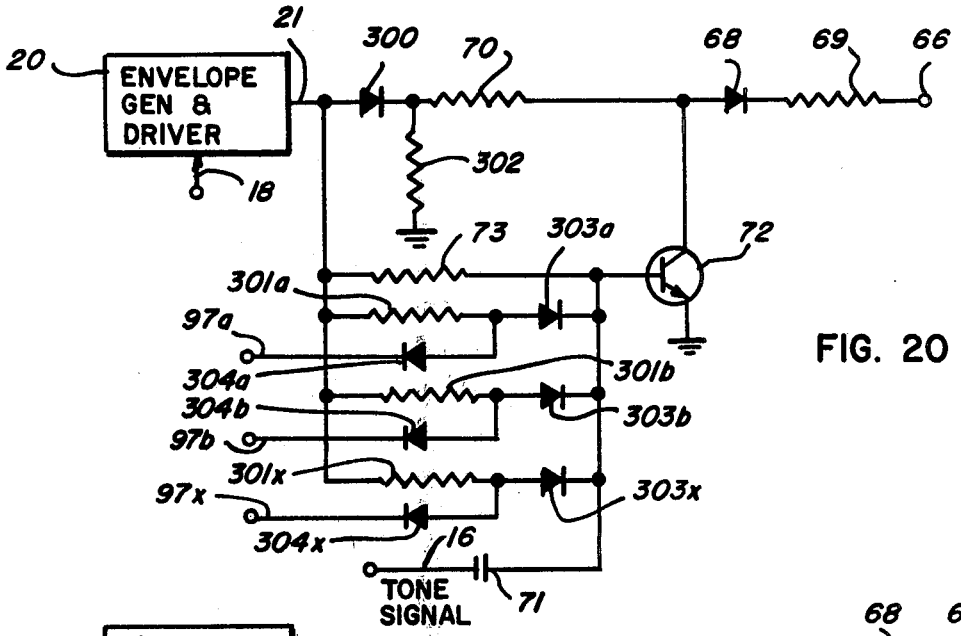
FIG. 20 is a schematic circuit diagram of another programmable keyer incorporating the present invention, in which the resistance of an RC circuit is programmed.

Referring now to FIG. 20, another programmable keyer 19 is illustrated which resembles at any given time the keyer illustrated in FIG. 2B. The envelope generator 20 is connected through diode 300, resistor 70, diode 68 and resistor 69 to output terminal 66. The junction of the diode 300 and the resistor 70 is coupled to ground through resistor 302. The output of the generator 20 is also connected by a resistor 73 to the base of transistor 72, which clamps the potential at the end of the resistor 73 to a voltage slightly above ground whenever the transistor is conductive.

The base of the transistor 72 is coupled to the musical tone signal line 16 through capacitor 71. A resistor 301*a* is connected in series with a diode 303*a* across the resistor 73, and a diode 304*a* is connected between the junction of the resistor 301*a* and the diode 303*a* to a line 97*a*. Additional lines 97*b* and 97*x* are connected in similar fashion with individual resistors 301*b* and *x* and individual diodes 304*b* and *x* and 303*b* and *x*. The lines 97 are connected to receive, from circuit 96 (see FIGS. 7 and 8), signals derived by decoding the octave or half octave code associated with the musical tone signal applied to the line 16. Each one of the decoded lines 97 which is presented with a relatively low level causes its associated diode 303 to be back-biased, and thus does not contribute to the operation of the circuit, which is similar to that described in connection with FIGS. 2B and 19. The decoded one of the lines 97, however, is at a relatively high level, so that its diode 303 is forward-biased, thus connecting a selected one of the resistors 301*a* through *x* in parallel relationship with resistor 73.

Just as in the prior art circuit of FIG. 2B, discharge of capacitor 71 during each negative-going half cycle of the musical tone signal occurs over a path leading from the envelope generator 20 through the resistor 73. However, the rate of capacitor discharge in the circuit of FIG. 20 is also affected by the choice of one of the different-valued resistors 301*a, b* or *x* to be connected across resistor 73 in shunt relationship therewith, whenever its associated one of the diodes 303*a, b* or *x* is forward-biased. The diodes 304*a, b* and *x* serve to isolate the non-selected decoder lines 97 from the keyer circuit.

The additional current which flows from capacitor 71 during discharge depends upon the value of the particular one of the alternative resistors 301*a, b* or *x* which is chosen to shunt resistor 73. The values of the resistors 301 are proportioned to the octave or half octave selection, which is dictated by the choice of a particular one of the decoder lines 97. Accordingly, the pulses produced at the terminal 66 have a duration which depends upon the decoding of lines 97. In practice, the values of the octave selection resistors 301 are chosen to be inversely proportional to the frequency of the musical tone signal applied to the line 16, so that the keyer of FIG. 20 is programmed to present output pulses at the terminal 66 with the same shape, irrespective of the frequency of the musical tone signal.

Figure 21:
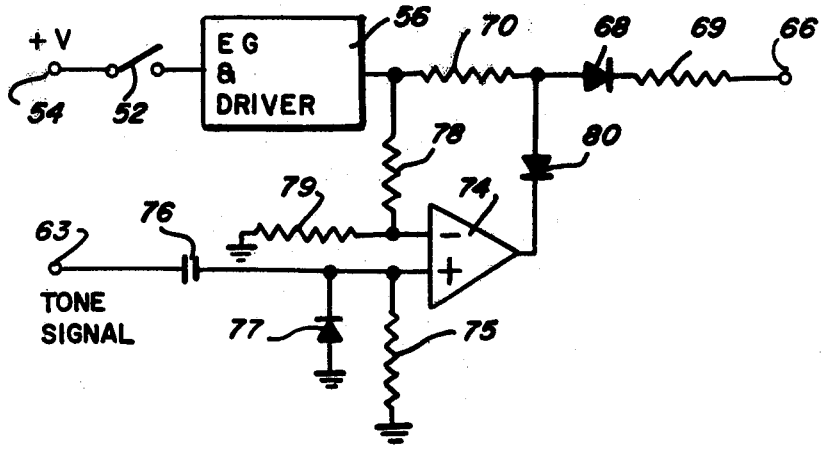
FIG. 21 comprises a schematic circuit diagram of a non-programmable keyer according to this invention which incorporates a comparator.

FIG. 21 illustrates a novel non-programmable keyer in which the chopping of the envelope is accomplished by using a comparator 74. The comparator has its non-inverting input connected to the junction of a resistor 75 and a capacitor 76, and coupled to ground through a diode 77. During negative half cycles of a musical tone signal (FIG. 3B) on terminal 63, capacitor 76 is rapidly charged up from −0.7 volts to ground through diode 77 and resistor 75, thus producing a voltage (FIG. 3F) at the non-inverting input of comparator 74 which is at ground potential or below. As a result, the output of the comparator 74 stays low, and clamps one end of the resistor 70 to ground, disabling the keyer circuit output. During the positive half cycles of the musical tone signal (FIG. 3B), the capacitor 76 discharges through resistor 75 towards ground (see FIG. 3F). The voltage at the inverting input of the comparator 74 is supplied from the envelope output signal through a voltage divider incorporating resistors 78 and 79. Whenever the voltage at the non-inverting input exceeds that applied to the inverting input, the output of the comparator 74 goes high, back-biasing a diode 80, and the envelope signal is made available through resistor 70, diode 68, and resistor 69 to the output terminal 66. The diode 80 prevents the high level output of the comparator from influencing the output of the keyer. The output waveform present at the terminal 66, when an exponential envelope signal is applied by circuit 56, is shown in FIG. 3G. As is the case with the prior art keyer in FIG. 2B, here again the duration of the output pulses decreases with increasing amplitude of the envelope signal; because the reference voltage input to the inverting terminal of comparator 74 is a function of the rising envelope voltage.

Figure 22:
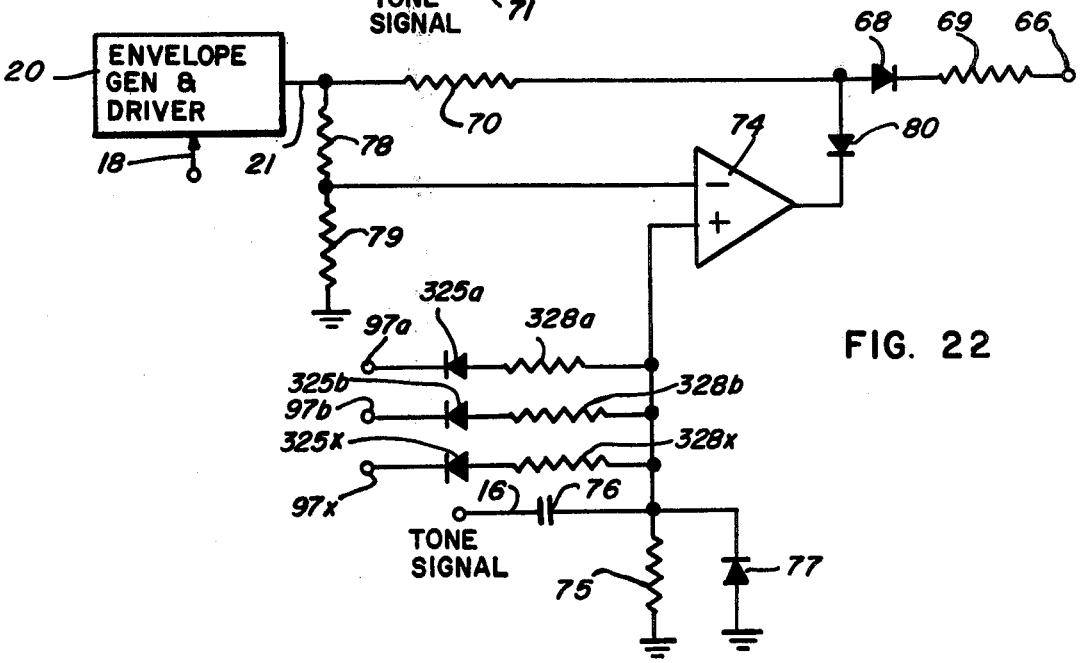
FIG. 22 is a schematic circuit diagram of a programmable version of the keyer seen in FIG. 21, in which the pulse duration of the output is controlled by programming the charging of a capacitor.

The non-programmable keyer of FIG. 21 is "tuned" to a small range of musical frequencies (just as are the prior art keyers of FIGS. 2A and 2B), because the discharge rate of the capacitor 76 through resistor 75 is fixed by the chosen RC values. To deal with this problem, FIG. 22 illustrates a keyer 19 which is a programmable version of the comparator-type keyer illustrated in FIG. 21. The circuit of FIG. 22 includes the three decoder output lines 97*a, b* and *x* (see FIGS. 7 and 8), each of which is connected to a respective series circuit including a diode 325*a, b* or *x* and a resistor 328*a, b* or *x*. The other end of each resistor is connected to the non-inverting input of comparator 74. A musical tone signal, applied to line 16, is applied through capacitor 76 also to the non-inverting input. The envelope signal output of circuit 20 is applied to the output terminal 66 through resistor 70, diode 68 and resistor 69. The voltage divider including resistors 78 and 79 is connected to the output of the envelope generator 20.

Depending upon which one of the lines 97 is selected by the decoder 96 (FIG. 7) to have a low potential impressed thereon, one of the diodes 325*a, b* or *x* is forward-biased, causing the associated one of resistors 328*a, b* or *x* to be connected in shunt relationship with resistor 75 as a parallel discharge path (through the decoder 96) for capacitor 76. The values of the resistors 328 are scaled in relation to each other, and selected in relation to the value of resistor 75, so as to change the discharge time of the capacitor 76, with the result that the durations of the pulses produced at the output terminal 66 are modified as a function of the musical tone frequency. Selection of the appropriate values for the resistors renders the width of the pulses produced at the terminal 66 inversely proportional to the musical frequency designated.

Figure 23:
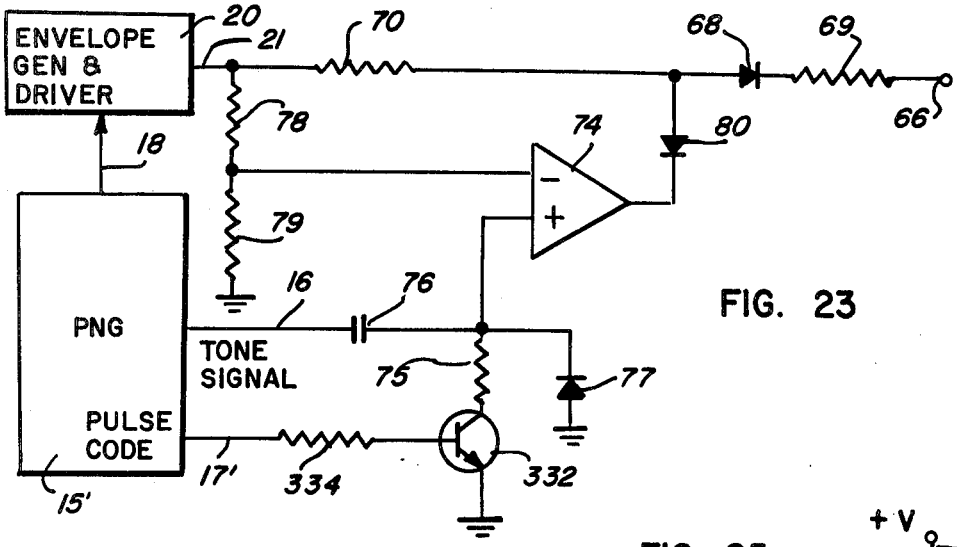
FIG. 23 is a schematic circuit diagram of a programmable keyer of the comparator type, in which the time constant is controlled by a variable duty cycle pulse code.

Referring now to FIG. 23, another programmable keyer 19 is illustrated which also uses the basic circuit of FIG. 21, but which employs the duty cycle modulation technique of FIGS. 11 through 17 to achieve programmability. The components which are common to the circuits of FIGS. 21 and 22 are indicated with identical reference numerals in FIG. 23. The capacitor discharge resistor 75 is in series with a transistor 332, and the duty cycle code on the line 17′ drives the base of the transistor through a resistor 334. As a result, the duty cycle of the transistor 332 in discharging the capacitor 76 through resistor 75, is determined by the duty cycle of the coded pulses on the line 17′.

Figure 24:
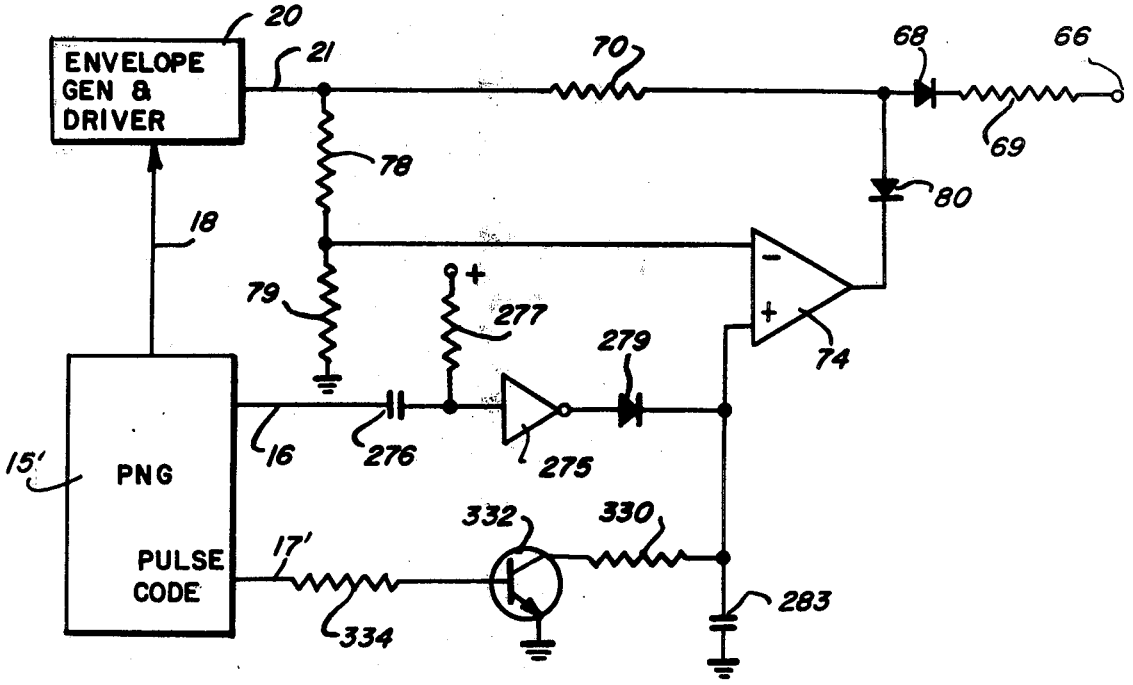
FIG. 24 comprises a schematic circuit diagram of an alternative form of duty-cycle-code-controlled comparator type programmable keyer incorporating the present invention.

FIG. 24 shows a similar keyer circuit 19, but one which has superior operating characteristics for small ratios of the pulse repetition rate on the line 17′ to the frequency of the musical tone signal on the line 16. Capacitor 276 is connected to the input of an inverter 275, which is also coupled to a source of positive voltage through a resistor 277. The capacitor 276 operates as a differentiator delivering spike inputs to the inverter 275; and the latter operates in a saturation mode in response to each negative spike Accordingly, the capacitor-inverter combination functions as a "half shot" circuit, and produces a short positive-going pulse once during each negative half cycle of the tone signal on the line 16. This pulse is coupled through a diode 279 to the non-inverting input of the comparator 74, and to one terminal of an integrating capacitor 283. The other terminal of the capacitor is connected to ground. The capacitor 283 is charged during each negative half cycle of the tone signal by the positive-going pulse from inverter 275, and serves to sustain the drive input to comparator 74.

The capacitor 283 is discharged to ground, during positive-going half cycles of the musical tone signal, through resistor 330 connected in series with transistor 332. It is this discharge rate which is programmed by the octave or half octave code. The base of the transistor 332 is coupled through resistor 334 to the width-modulated pulse code line 17′, which alternately renders the transistor 332 conducting and non-conducting. When the pulse train applied to the line 17′ has a relatively high duty cycle the transistor 332 operates more continuously and the capacitor 283 is discharged quickly; when the duty cycle is low, the capacitor 283 is discharged more slowly.

Since the ungrounded terminal of the capacitor 283 is connected to the non-inverting input of the comparator 74, the capacitor makes the comparator effective to back-bias the diode 80 during a part of each musical tone signal cycle. The duration of that part of the cycle depends on the rate of discharge of the capacitor 283. By programming the pulse code on line 17′ in the manner described above, the duty cycle of the pulses produced on the output terminal 66 (see FIG. 12B) can be made to depend on the frequency of the musical tone signal.

The keyer circuits of FIGS. 23 and 24 represent improvements over those of FIGS. 20 and 22, although producing the same result, since they require fewer components. In FIGS. 23 and 24, the input impedance of the comparator 74 is high enough so that it does not unduly load the capacitor 76 or 283.

Figure 25:
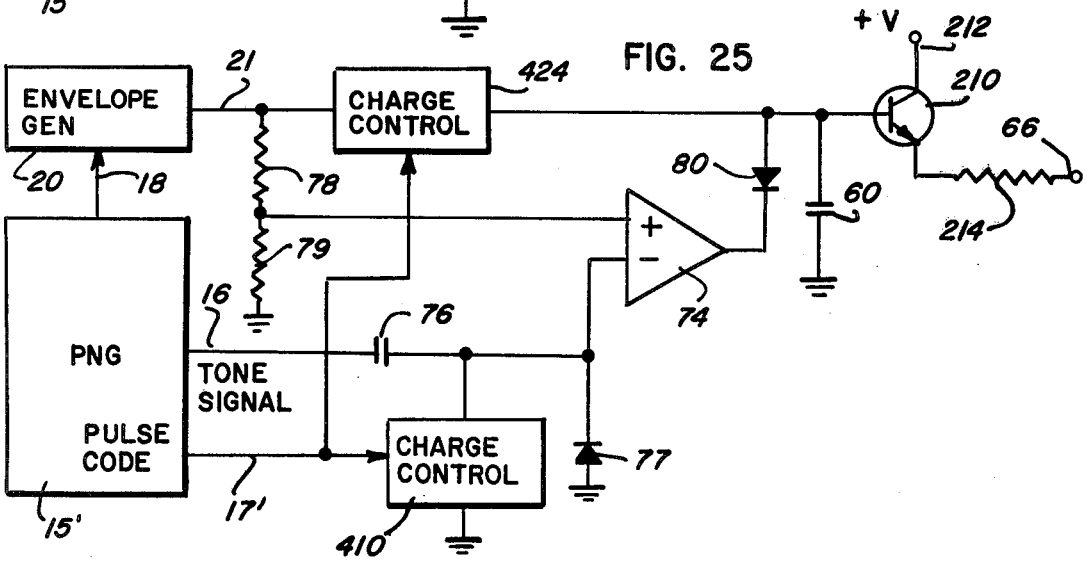
FIG. 25 illustrates a schematic circuit diagram of an alternative programmable keyer incorporating the present invention.

Referring now to FIG. 25, a programmable keyer 19 is illustrated in which the output is a variable width sawtooth signal, combining features of the sawtooth output keyer circuits and the variable output pulse width keyer circuits described above. Here again, a capacitor 76 has one terminal connected to a musical tone signal present on line 16 of the priority note generator 15′, and the other terminal coupled to ground through diode 77. The capacitor 76 is clamped to ground by the diode 77 during the negative-going half cycles of the musical tone signal. During positive-going half cycles of the tone signal, the capacitor is discharged to ground through a charge control device 410, which can be any conventional three-terminal circuit or device, such as a transistor, which controls current in response to a control signal. The device 410 has an input terminal connected to ground, an output terminal connected to the capacitor 76, and a control terminal connected to the duty-cycle-modulated control pulses on the line 17′ coming from the priority note generator 15′.

The junction of the capacitor 76 and the diode 77 is also connected to the inverting input of comparator 74, which is the opposite of the preceding embodiments. Here it is the non-inverting input which is connected to the output of voltage divider 78, 79. The input of the voltage divider is the envelope output.

Figure 3I:
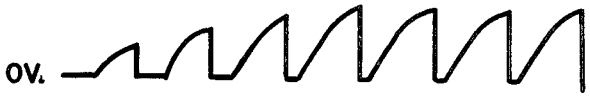

Because the input connections of the comparator 74 here are reversed relative to FIG. 23, the output (FIG. 3I) of the comparator in FIG. 25 has a progressively increasing pulse width as the amplitude of the signal from envelope generator 20 increases (compare FIGS. 3A and 3I). This is opposite to the result produced in the circuits of FIGS. 2B, 18, 19, 21 and 25; and it gives a different musical timbre to the output signal, which is desired at certain times. The organ player can call forth that particular timbre at will by using the organ voicing switches to connect keyers of the FIG. 25 type into the circuit of FIG. 1, and disconnecting the other type.

The output of the comparator 74 is coupled through diode 80 to one terminal of capacitor 60, the other terminal of which is grounded. The capacitor 60 is discharged through the diode 80 during negative half cycles of the output of the comparator 74. When the output of the comparator 74 is high, the diode 80 is back-biased, and the charge on the capacitor 60 is then independent of the output of the comparator 74. During this period the capacitor 60 is charged through a second charge control device 424, in proportion to the potential available on the output line 21 from the envelope generator 20. The charge control circuit 424 has its control input connected to the pulse code line 17′ so that it is responsive to the pulse code for controlling the rate at which the capacitor 60 is charged by the output of the envelope generator 20.

Figure 3J:
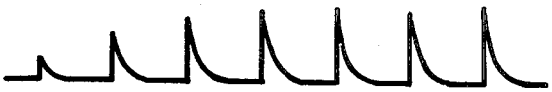
Figure 26:
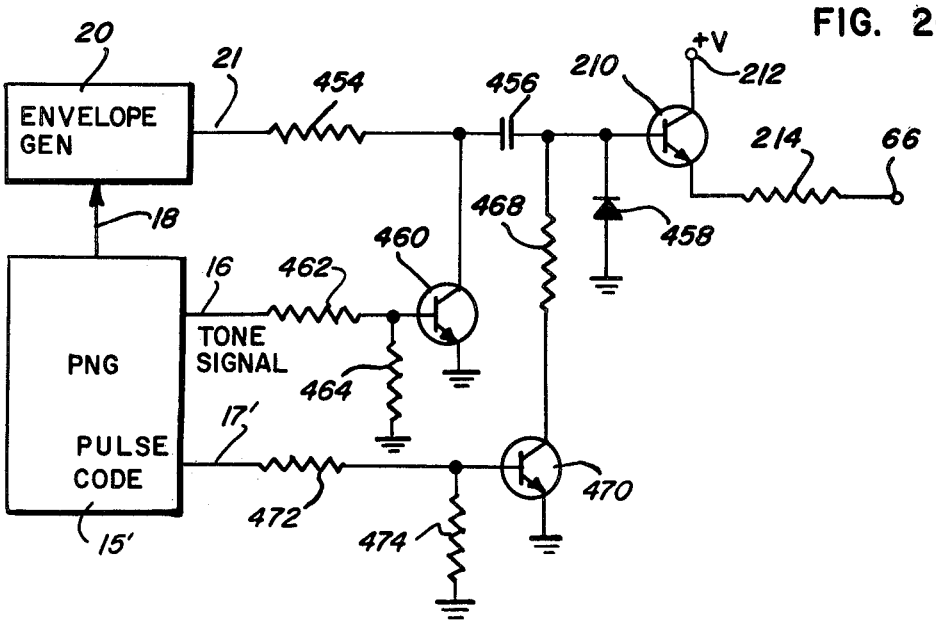
FIG. 26 illustrates a schematic circuit diagram of another programmable keyer incorporating the present invention.

Referring now to FIG. 26, another type of programmable keyer is illustrated in which the output signal is neither a sawtooth wave-form, nor a rectangular pulse, but a "spike" wave-form as seen in FIG. 3J.

The envelope generator 20 furnishes an envelope signal on line 21, which is connected through a resistor 454, a differentiating capacitor 456 and a diode 458 to ground. The junction of the resistor 454 and the capacitor 456 is connected to the collector of an envelope-chopping transistor 460, the emitter of which is grounded. The base of the transistor 460 is connected to receive a musical tone signal from the output of a voltage divider including resistors 462 and 464. The input of the divider is supplied over the line 16 from the priority note generator 15′. The transistor 460 saturates during positive-going cycles of the musical tone signal on the line 16, and cuts off the transistor 210 by shunting the envelope signal to ground. During negative-going half cycles of the tone signal, the envelope signal is transferred through the capacitor 456 to the base of the transistor 210, causing the latter to conduct. The capacitor 456 is discharged through a resistor 468, by conduction of a programming transistor 470, the collector-emitter path of which is connected in series between the resistor 468 and ground. In order to program the discharge rate of capacitor 456, the base of the transistor 470 is connected to the output of a second voltage divider, resistors 472 and 474. The input of this divider is supplied over the pulse code line 17' from the modified priority note generator 15', which supplies a series of pulses width-modulated according to the audio frequency of the musical tone signal. The duty cycle of the transistor 470 is modified in accordance with the widths of the pulses applied to the line 17', which changes the rate of discharge of the capacitor 456.

The junction of the resistor 468 and the capacitor 456 is connected to the base of transistor 210, which produces an output signal at terminal 66 in response to its base drive voltage. Because of the differentiating action of capacitor 456, this voltage reaches a maximum beginning immediately at the onset of the negative half cycle of the musical tone signal applied to the line 16, and thereafter decays exponentially in accordance with the effective discharge rate of the differentiating capacitor 456 through resistor 468 and programming transistor 470. When the charging rate is made proportionally higher for higher audio frequencies, by means of a higher duty cycle signal applied to the pulse code line 17', the output of the circuit of FIG. 26 (shown in FIG. 3J as spikes with sharp leading edges and exponential trailing edges) is characterized by a more rapid rate of exponential decay of the trailing edges, as is appropriate for higher frequency tones.

Figure 27:
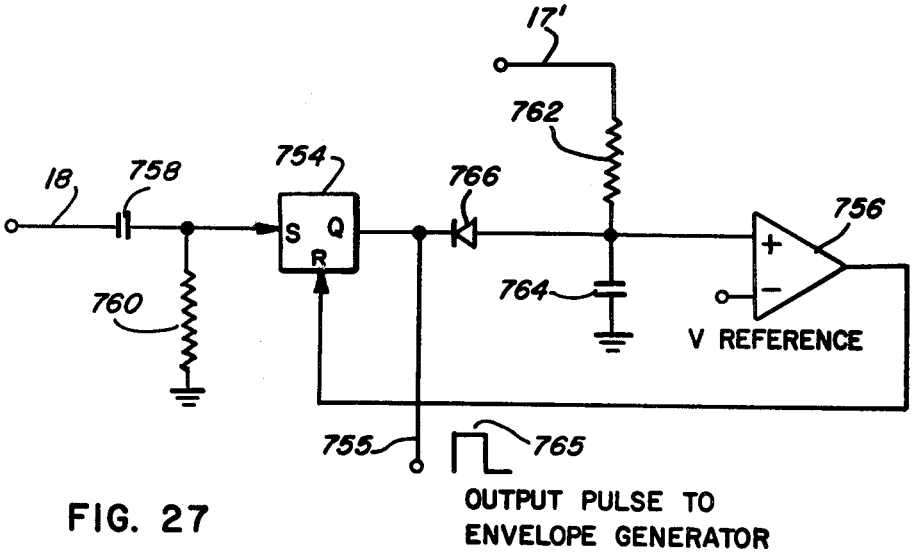
FIG. 27 is a programmable one-shot circuit for use in making the prior art percussive envelope generator circuit of FIG. 2D programmable in accordance with this invention.

Turning our attention next to the subject of envelope generators, the variable duty cycle pulse code technique can be used to program the one-shot circuit which is used with an envelope generator to obtain a percussive envelope. Specifically, the one-shot circuit 90 used with the envelope generator 56 of FIG. 2D can be designed in accordance with FIG. 27 to make the circuit of FIG. 2D programmable. The timing circuit of the one-shot circuit in FIG. 27 is an RC network 762, 764 which is connected to the input of comparator 756. This timing network is driven by the variable duty cycle pulse code on line 17'. Normally, the capacitor 764 is able to discharge through a diode 766 and the Q terminal of flip-flop 754 to a ground (not shown) which is internal to the flip-flop. But the diode 766 is back-biased by the high Q output from flip-flop 754 when the flip-flop turns on; then the voltage on capacitor 764 requires a period of time to rise to the level of the turn-on threshold of comparator 756. The duty cycle of the pulse code input determines the rate of rise of the voltage which capacitor 764 applies to comparator 756. That rise rate in turn determines the delay time until the feedback from the output of comparator 756 is applied to the reset input of flip-flop 754, and thus determines the duration of output pulse 765 on line 755. The line 755 provides the output to drive an envelope generator, such as any of the circuits 56 or 20 described herein.

The same programming result can be achieved through bit-parallel coding (i.e. using the technique of FIGS. 7 and 8) to choose among a plurality of alternative different-valued resistors to connect in the circuit where resistor 762 appears, and connecting the chosen resistor to a constant voltage source instead of to the pulse code line 17'.

Figure 28:
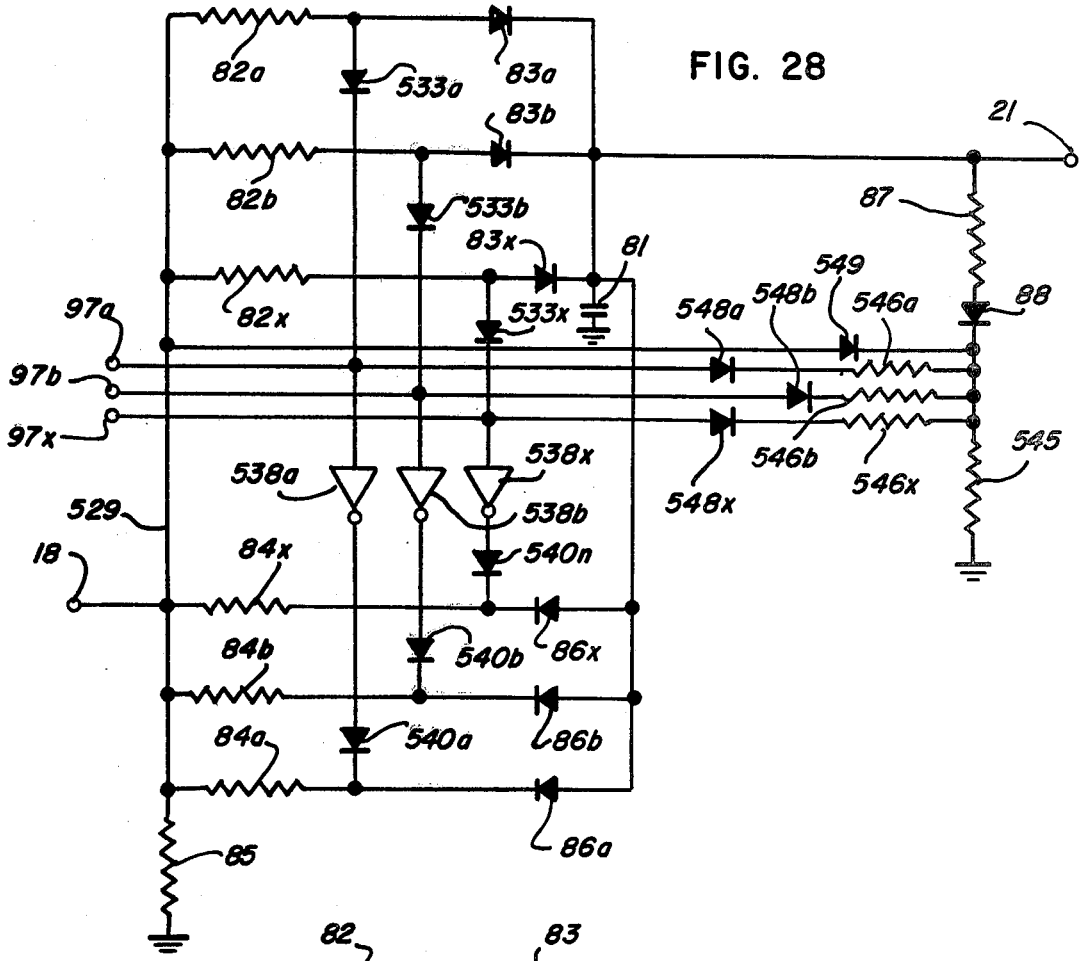
FIG. 28 is a schematic circuit diagram of a bit-parallel code programmable envelope generator and driver circuit incorporating the present invention.

The prior art envelope generator and driver described in connection with FIG. 2C produces an attack-decay type of wave-form, as shown in FIG. 4B. Often, it is desirable for the attack and decay characteristics of the higher audio frequency musical tone signals to be different from those of the lower musical tones. The circuit of FIG. 2C is not suitable for this purpose, because it is not responsive to the frequency of the musical tone signal. The circuit of FIG. 28 is a programmable form of the envelope generator and driver 20 used in FIG. 1, which is responsive to the decoded program control signal on lines 97 representative of the audio frequency of a selected musical tone signal. In discussing this circuit, like reference numerals will be used to call attention to the similarities with FIG. 2C.

In the circuit of FIG. 28, the attack slope, the decay slope, and the snub level (see discussion above of FIG. 4B) of the envelope output signal made available on output line 21 are all programmable. The control signal, which indicates the audio frequency of the tone signal, is the decoded bit-parallel control signal which is developed on lines 97 by the associated one of the keyers 19 (see, for example, FIGS. 7 and 8). The keyer may be any of the programmable types described above which employs bit-parallel octave coding.

One of the octave selection lines 97*a*, *b* or *x* receives a decoded signal input from decoder 96 indicating the octave or half octave of the musical tone signal. Another input is the envelope activating signal on line 18 from priority note generator 15 (see FIG. 1). This signal is connected over a line 529 and coupled through resistor 82*a* and diode 83*a* to one terminal of capacitor 81, the other terminal of which is grounded. The junction of the resistor 82*a* and the diode 83*a* is connected by means of a diode 533*a* to the octave selection line 97*a*. When the potential on the line 97*a* is low, the junction between the resistor 82*a* and the diode 83*a* is effectively clamped to the low potential, by conduction through a diode 533*a*, and capacitor 81 cannot be charged through resistor 82*a*. When the voltage level of the line 97*a* is high, however, the diode 533*a* is back-biased, and the capacitor 81 is no longer prevented from charging through the resistor 82*a* and the diode 83*a*, toward the envelope activating potential applied to the activating input line 18.

A first discharge path to ground for the capacitor 81 includes a diode 86*a* and two series-connected resistors 84*a* and 85. The junction of the resistors 84*a* and 85 is connected to the activating input line 18, so that the diode 86*a* is back-biased during charging of the capacitor 81, i.e. when activating line 18 is energized. But when the line 18 goes low, the capacitor 81 is discharged through the diode 86*a* and the resistors 84*a* and 85.

The line 97*a* is connected to the input of an inverter 538*a*, the output of which is connected through a diode 540*a* to the junction of the diode 86*a* and the resistor 84*a*. Accordingly, when the potential on the line 97*a* is low, the junction of the diode 86*a* and the resistor 84*a* is held high, back-biasing the diode 86*a* and rendering the first capacitor discharge path inoperative. However, when the capacitor 81 is charged through the resistor 82*a*, the potential on the line 97*a* is high, so that the described first discharge path is effective.

A second discharge path for the capacitor 81, a snub discharge path, employs resistor 87, diode 88, and a resistor 545. The cathode of the diode 88 is held at a snub potential, which is developed by a voltage divider including a resistor 546*a* and the resistor 545. The input of this voltage divider is coupled to the line 97*a* through a diode 548*a*, so that the snub potential is a fraction of the voltage supplied to the line 97*a*, established by the ratio of the resistances of the resistors 545 and 546*a*. A diode 549 is connected from the input line 18 to the junction of the diode 88 and the resistor 545, to disable the snub discharge path by back-biasing the diode 88 when the capacitor 81 is being charged.

All of the components of FIG. 28 thus far described which have reference numerals with the suffix "a" are controlled by the potential applied to the octave selection line 97*a*. Corresponding components having reference numerals labeled with the suffixes "b" and "x" are associated with the other octave selection lines 97*b* and *x* for charging the capacitor 81 through resistors 82*b* and *x*, respectively, and for discharging it through resistors 84*b* and *x*, respectively. The octave selection line 97*b* is also connected through a diode 548*b* and a resistor 546*b* to the cathode of the diode 88, and the octave selection line 97*x* is connected by a diode 548*x* and a resistor 546*x* to the same point. The circuits which are associated with the octave selection lines 97*b* and *x* are made effective, in the same way as described above, when high potentials are applied to the lines 97*b* and *x*. When low potentials are applied to any of the lines 97, these circuits are ineffective. The decoder 96 (FIG. 7 or 8) deciphers the octave or half octave code and enables only one of the decoder output lines 97 at any one time. Consequently, the charge and discharge rates of the capacitor 81, and the snub potential, are all varied in response to selection of the musical tone signal and its associated octave code. In this embodiment, the lines 97 correspond to program control input 22 in FIG. 1.

When the circuit of FIG. 28 operates in response to the octave or half octave code, as described, the rate of charge and discharge of the capacitor 81 is made to vary directly with the musical tone signal frequency, and the snub voltage is made to vary inversely with the musical tone frequency, to produce more of a percussive effect for musical tone signals of higher frequency. This exceptional versatility is achieved with the use of only a single capacitor 81.

Figure 29:
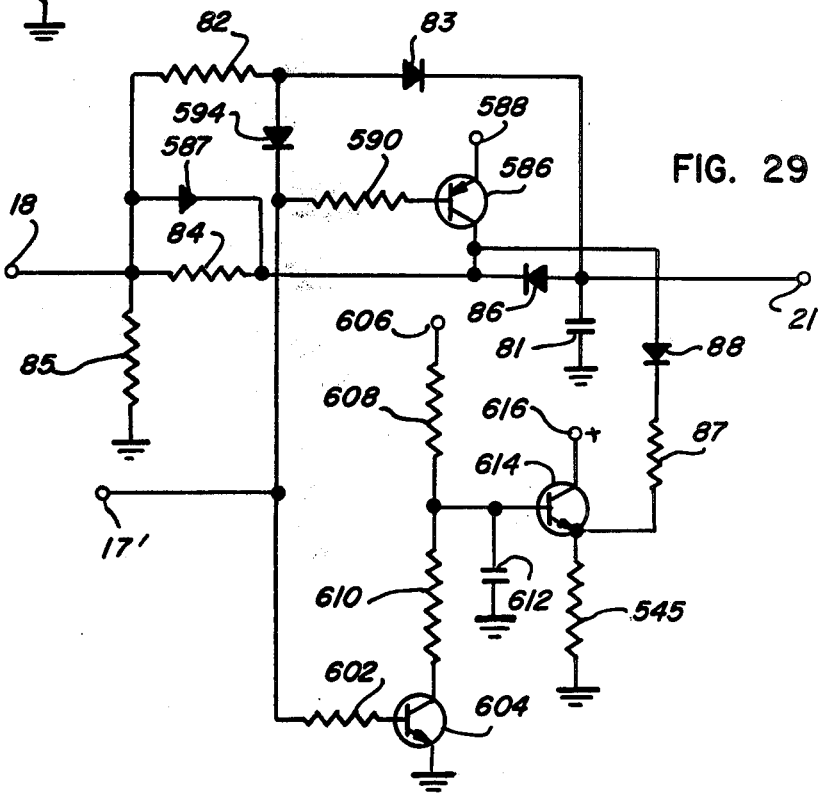
FIG. 29 is a schematic circuit diagram of an alternative form of programmable envelope generator and driver, in which a duty cycle code is used for programming.

FIG. 29 shows an alternative form of programmable envelope generator 20 for use in FIG. 1, in which the duty cycle modulation technique is used to establish the characteristics of the charging path of capacitor 81 and both of its discharge paths. The capacitor 81 is charged toward the envelope activating voltage applied to line 18 (see FIG. 1) through resistor 82 and diode 83, when the activating line 18 goes high. Thereafter, capacitor 81 is discharged over a first path through diode 86 and resistors 84 and 85. The junction of the resistors 84 and 85 is connected to the line 18, so that the first discharge path is inhibited by back-biasing of diode 86 as long as the line 18 is high.

A control transistor 586 has its collector connected to the junction of the diode 86 and the resistor 84, and its emitter connected to a source of positive potential at a terminal 588. Its base is coupled through a resistor 590 to duty cycle code line 17'. The latter is also connected by a diode 594 to the junction of resistor 82 and diode 83.

When a high potential appears on the pulse code line 17' and the activating line 18 simultaneously, the diode 594 is back-biased so that the capacitor 81 charges through the resistor 82. After the activating line 18 goes low, the capacitor 81 is discharged through the diode 86 and the resistors 84 and 85.

When the potential applied to the pulse code line 17' is low, however, the envelope activating voltage on line 18 is unable to charge capacitor 81 through the resistor 82 because one end of that resistor is clamped to the low potential by diode 594 and line 17'. The capacitor 81 is also prevented from discharging through the resistors 84 and 85, when the potential on the line 17' is low, because the low potential drives the transistor 586 into saturation, causing it to conduct through the resistors 84 and 85, which results in back-biasing the diode 86. The code line 17' thus controls both the charging circuit and the first discharging circuit of capacitor 81. The effective RC time constants of these circuits are modified in accordance with the duty cycle of the coded pulse train applied to that line. As a result, the length of the attack phase of the envelope output signal at the terminal 21 and its decay phase are both dependent on the duty cycle of the coded pulse train applied to the line 17', which is selected in accordance with the audio frequency of the musical tone signal. Note that in this embodiment, the pulse width code line 17' corresponds to the control input 22 of FIG. 1. Note also that diode 594 and transistor 586 may be replaced by analog switches or other switching devices, if desired.

A second capacitor discharge path, which is effective only until the voltage on capacitor 81 decays to the snub level, includes resistors 545 and 87 and diode 88. The snub level voltage, which is applied to the lower end of resistor 87, is determined by the duty cycle of the pulse code train on the line 17' in the following manner. The line 17' is coupled by a resistor 602 to the base of a transistor 604, which has its emitter connected to ground and its collector coupled to a source of positive potential at a terminal 606 through two series resistors 608 and 610. A capacitor 612 is connected from the junction of the resistors 608 and 610 to ground, and this junction is also connected to the base of a transistor 614, which has its collector connected to a source of positive potential at a terminal 616 and its emitter connected to the lower end of resistor 87. The latter point is coupled through resistor 545 to ground.

In operation, the network including resistors 608 and 610 and capacitor 612 functions as a low pass filter. As a result, the capacitor 612 is charged to an average value which is proportional to the duty cycle of the coded pulse train present on the line 17'. The transistor 614 functions as an emitter follower, the output voltage of which is presented to the lower end of the snub circuit resistor 87. Accordingly, the snub level is controllable by the duty cycle of the coded pulse train applied to the line 17'.

The snub voltage produced at the emitter of the transistor 615 decreases with increasing duty cycle of the coded pulse train, while the capacitive discharge rate controlled by the transistor 586 increases. All of the functions of the circuit of FIG. 28 are accomplished by the circuit of FIG. 29, using substantially fewer components.

One caveat about the programming of envelope generators is in order at this point. Unlike keyers and other programmable circuits in which the programmed capacitor charging or discharging rates are in a 2:1 ratio from octave to octave, envelope generator parameters may not be so steeply scaled without producing undesirable audio effects. Thus, it follows that, while a 2:1 pulse duty cycle ratio from octave to octave is appropriate when the pulse duty cycle code approach is used for keyers or other types of programmable circuits generally, a different duty cycle ratio from octave to octave must be used when employing the pulse duty cycle code to program an envelope generator (or to program a one-shot circuit used with an envelope generator to make it percussive). Thus, a given pulse duty cycle code generator may not be used for programming both a keyer or other circuit and an envelope generator or a one-shot. Instead, two different pulse duty cycle code generator circuits, with different scaling factors developed through different decoding logic, are required. In the case of bit-parallel code programming, however, the same code generator can be used to program both keyers or other circuits and envelope generators or one-shots; because the appropriate scaling factors can be varied externally of the code generator by choosing different resistor scaling factors for the envelope generator (or one-shot) as compared to other target circuits.

The snub voltage generator by a circuit like that of FIG. 28 or FIG. 29, being a d.c. potential which is proportional to the frequency of the musical tone signal, can also be used as a control voltage to control other circuits of the electronic musical instrument, such as the voicing circuits, so that the voicing effect can be tailored to the audio frequency of the tone signal. Conventional voltage-controlled filter circuits may be used for this purpose.

It is also possible to use the octave code to execute a switching function to control the values of resistors or capacitors within a programmable filter circuit 24 (see FIG. 1). An illustrative embodiment of a programmable filter circuit is seen in FIG. 30, which shows an active filter circuit incorporating two resistors 625 and 626 connected in series between an input terminal 628 and the input of an amplifier 630, the output of which is connected to an output terminal 632. A feedback capacitor 634 is connected between the output terminal 632 and the junction of the resistors 625 and 626. A circuit incorporating a coupling capacitor 636 and a resistor 638*a* is connected in series with an analog switch 620*a* across the resistor 625, and a similar circuit incorporating a coupling capacitor 622 and a resistor 624*a* is connected in series with an analog switch 627*a* across the resistor 626. When the analog switches 620*a* and 627*a* are operated by a control potential on a line 97*a*, the capacitor 636 and the resistor 638*a* are effectively in series across the resistor 625, and the capacitor 622 and the resistor 624*a* are effectively in series across the resistor 626.

A circuit incorporating a resistor 638*x* is connected in series with an analog switch 620*x* and the coupling capacitor 622 across the resistor 626. The analog switches 620*x* and 627*x* are operated by a control voltage on a line 97*x*.

The resistors 624*a* and *x* and 638*a* and *x* affect the charging rate of a filter capacitor 635. Depending on whether the line 97*a* or *x* is energized, the resistors 638*a* and 624*a* or else the resistors 638*x* and 624*x* are incorporated into the filter circuit, thereby changing its frequency-dependent characteristics. The lines 97 are energized one at a time by the decoder 96 (see FIG. 7) in accordance with the octave code of a musical tone signal supplied to the input terminal 628 by one of the keyers 19 (see FIG. 1).

FIG. 31 illustrates another active filter circuit 24, this one being programmed by the use of a variable duty cycle pulse code. The filter again has a musical tone signal receiving input terminal 628. The input terminal receives a signal from the output of a keyer circuit 19 (FIG. 1), and is coupled through analog switch 620 to one end of resistor 638 and then through the second analog switch 627 to the second resistor 624. The other end of the resistor 624 is connected to an amplifier 630 which drives the output terminal 632. Feedback capacitor 634 is connected from the output terminal 632 to the junction of the resistor 638 and the analog switch 627.

The resistors 638 and 624 determine the charging rate of capacitor 635. When the analog switches 620 and 627 are in their "on" condition all the time, the filter has one characteristic. When the switches 620 and 627 are operated with various lower duty cycles, however, the filter has various different characteristics, because of the change in the average current of the resistors 638 and 624. Both of the analog switches 620 and 627 are connected to a common control line 17' (FIG. 10) which receives the variable duty cycle coded pulse train. The duty cycle of this pulse train is related to the frequency of the musical tone signal applied to the terminal 628, and controls the filter so as to provide a substantially constant voicing effect on the tone signal, irrespective of its frequency.

In a different arrangement of a programmable filter circuit 24, illustrated in FIG. 32, the terminal 628, which receives the musical tone signal output of a keyer 19, is coupled to a plurality of alternative fixed (i.e. non-programmable) filters. It is coupled through a resistor 675*a* and diode 677*a* to the input of a filter Fa, through a resistor 675*b* and a diode 677*b* to the input of a second filter Fb, and through a resistor 675*x* and diode 677*x* to filter Fx. The junction of the resistor 675*a* and the diode 677*a* is coupled through a diode 679*a* to a first control line 97*a*, and the other corresponding junctions are coupled through diodes 679*b* and 679*x* to control lines 97*b* and 97*x* respectively. One of the three control lines 97 is energized by decoder 96 (FIG. 7), depending upon the octave code of the musical tone signal. Thus, the particular filter Fa, b or x which is included in the circuit is selected to match the audio frequency of the musical tone signal. The filters are scaled to give the same voicing effect to the musical sound produced by the instrument, irrespective of the audio frequency of the tone signal. Series or series-shunt analog switches can replace the diodes 675 and/or 677 if desired.

In the various programmable filter circuits of FIGS. 30 through 32, the program control input lines 97 or 17' correspond to the input lines 25 of FIG. 1.

Referring now to FIG. 33, an alternative embodiment of the present invention is illustrated, in which a single programmable wave-shaping circuit may be used to control the keying of a plurality of different voices. This embodiment uses a wave-shaping circuit 700 which is constructed somewhat like the keyer circuit illustrated in FIG. 18. Components which are the same as in the circuit of FIG. 18 are identified with the same reference numerals. The transistor 210 has its emitter coupled to ground through a resistor 701, and the emitter is also connected to the inputs of two conventional two-quadrant multiplying circuits 704 and 706. A second input of each of the two-quadrant multipliers is derived from respective envelope generators 20*a* and 20*b*.

The envelope generator 20*a* is associated with the multiplier 704, and receives an activating input signal over line 18 from the priority note generator 15'.The envelope generator 20*a* is a slow attack generator, meaning that the signal on the line 18 causes the generator 20*a* to produce a relatively slowly rising wave-form, which wave-form is applied over a line 710 to the two-quadrant multiplier 704. The operation of the two-quadrant multiplier 704 is to use the sawtooth wave produced by the wave-shaping circuit 700 to modulate the envelope voltage on the line 710, and supply the modulated result to an output line 712.

A percussion envelope generator 20b is associated with the multiplier 706. The envelope generator 20b receives the signal over the line 18 and generates a percussion envelope on a line 716 which is connected to an input of the multiplier 706. The output signal from the multiplier 706 is produced on a line 718, at which appears the product of modulating the sawtooth signal on line 66 with the percussion wave-form on the line 716.

The signal on the line 18 is connected to two additional envelope generators 20c and 20d, each of which produces a signal connected to an input of a separate two-quadrant multiplier. A multiplier 724 is associated with the generator 20c, and a multiplier 726 is associated with the generator 20d. The second input of both the multipliers 724 and 726 is derived from a line 728 which comes from the output of a programmable filter 730. The programmable filter has a signal input connected by lines 732 and 66 with the sawtooth output of the wave-shaping circuit 700, plus a duty cycle code programming input connected over line 17'. The characteristics of the filter 730 are programmed by the duty cycle of the pulse code on the line 17' as described above in connection with FIG. 31.

The envelope generator 20c furnishes a slow attack, like the generator 20a, while the generator 20d furnishes a percussion envelope, like the generator 20b. The outputs of the multipliers 724 and 726 are provided respectively to output lines 736 and 738.

It is apparent in FIG. 33 that four separate modulated signals are produced on the four output lines 712, 718, 736 and 738, which signals have different musical voicing characteristics, e.g., they differ in their envelope wave-shapes and in their harmonic content. These lines are conveniently connected to the several collector buses of the electronic musical instrument, and the signals on the various buses of each circuit 700 are played either singly or in combination as musical sounds in accordance with the particular organ keys and voicing tabs which are employed at any given time. Through the use of the present invention, it is necessary only to use a single programmable wave-shaping circuit 700 for each note, instead of a separate programmable keyer for each of several envelope generators. This results in a considerable economy of structure in an instrument incorporating the present invention.

The envelope generators 20 are all turned on and off by the priority note generator 15' by means of the activating signal on line 18. Which particular envelope generators 20 respond to the signal on line 18 depends upon the player's selection of organ voicing tabs, by which one or more musical voices can be selected.

The wave-shaping circuit 700 is programmable in accordance with the pulse code on the line 17' in a manner similar to that which has been described in connection with the keyer circuit of FIG. 18. During negative half cycles of the musical tone signal on the line 16, the capacitor 60 is discharged through the diode 206, and during positive half cycles of the signal on the line 16, the capacitor is charged through resistor 58 and diode 245, at a rate which is dependent on the duty cycle of the pulse code appearing on the line 17'. Accordingly, the slope of the sawtooth wave-form output (illustrated) is dependent on the duty cycle of the pulse code on the line 17', while the period of each pulse is dependent on the audio frequency of the musical tone signal applied to the line 16. By making the pulse duty cycle on the line 17' proportional to the audio frequency of the musical tone signal applied to the line 16, the resulting sawtooth pulses can be made to maintain the same wave-shape, irrespective of the frequency of the musical tone signal which is employed.

The circuit 700 is designed to produce a stream of pulses of equal peak amplitude, i.e. they do not conform to an envelope, because they are subsequently mixed with one of the envelope outputs when processed by one of the multiplier circuits 704, etc. The same result can be accomplished by modifying any of the programmable keyer circuits described above, by connecting their envelope signal input lines 21 to a source of constant supply voltage instead of to the rising and falling envelope voltage. The audio frequency musical tone signal on line 16 and the program control code signal on one of the lines 97 (decoded bit-parallel digital code) or on line 17' (duty-cycle-modulated serial code) are injected into the circuit in the same manner as described above for the envelope-driven keyer circuits.

The three specific examples in FIGS. 34, 35 and 36 will suffice to illustrate the principle. The circuit of FIG. 34A is a programmable circuit similar in operation to that of FIG. 8; but it produces on output terminal 66 the equal peak amplitude output pulses seen in FIG. 34B, because the resistors 58 are connected to a source of constant supply voltage on terminal 750, instead of to a varying envelope signal (line 21 in FIG. 8). The circuit of FIG. 35A is similar in operation to that of FIG. 9, but for the constant supply voltage input on terminal 750, which produces the equal amplitude output pulses seen in FIG. 35B. The circuits in FIGS. 34A and 35A are both programmed by a signal on one of the lines 97, representing the decoding of a bit-parallel octave or half octave word instruction as described above. The circuit of FIG. 36A is similar to that of FIG. 24, and is similarly programmed by the serial duty cycle code on line 17'. The constant supply voltage input on terminal 750 causes the comparator output on terminal 752 (FIG. 36B) to consist of equal amplitude pulses. In each of the circuits of FIGS. 34 through 36, the audio tone signal is injected over line 16.

It will now be appreciated that this invention provides various novel keyer, envelope generator, wave-shaper and filter circuits most of which are programmable in such a way that they are suitable for use over the entire musical range of an electronic instrument. As to those circuits which are programmable, the breadth of this invention is such as to include, not only the particular embodiments disclosed for exemplification herein, but, more generally, all musical tone generating means in which the problem of frequency dependence is solved by changing the critical charging or discharging rate of a capacitor or other reactive component in response to a program control signal coming from the same means which assigns the frequency-dependent circuit to the production of a particular musical tone, so that the critical charging or discharging rate tracks the assigned musical tone frequency.

I claim:

1. In an electronic musical instrument having musical note selection means producing a first control signal for note selection purposes, and circuit means for producing electrical tone signals, said circuit means including at least one circuit which is frequency-dependent by virtue of the fact that it has means defining a critical charging or discharging rate, which critical rate is suitable for operation only over a limited musical frequency range, and note assignment means responsive to said note selection signal to assign said frequency-dependent circuit to participate in the production of a tone signal within a range of musical frequencies exceeding its limited operating range; the improvement wherein: said note assignment means produces a second control signal for programming purposes, and said circuit means includes programming means responsive to said program control signal for adjusting said critical charging or discharging rate to suit the frequency of a selected musical note which is assigned to said frequency-dependent circuit by said note assignment means.

2. An instrument as in claim 1 wherein said critical charging or discharging rate is defined by component means of first and second impedance types respectively, said component means of at least one of said impedance types being arranged for selective variation of the effective value of the impedance thereof, and said programming means operates by adjusting said variable impedance value to a level which cooperates with the impedance of said component means of said other impedance type to adjust said critical charging or discharging rate to a level such that said frequency-dependent circuit operates satisfactorily at the frequency corresponding to the assigned musical note.

3. An instrument as in claim 2 wherein said component means comprise at least one component of a first one of said impedance types and a plurality of components of the second of said impedance types, and said programming means comprises means for switching different components of said second impedance type into operative association with said component of said first impedance type in a manner to select different effective values of said second impedance to be associated with said first impedance, whereby the selected impedance value results in a critical charging or discharging rate which adapts said frequency-dependent circuit to operate satisfactorily at the frequency corresponding to the assigned musical note.

4. An instrument as in claim 3 wherein said components of said second impedance type have substantially different impedance values from each other, and said switching means is effective to associate only a selected one at a time of said components of said second impedance type operatively with said one component of said first impedance type, whereby the satisfactory operating range of said frequency-dependent circuit is substantially shifted by selection of said second impedance value.

5. An instrument as in claim 4 wherein: said switching means includes decoding means having input and output terminals, and means connecting said output terminals for uniquely selecting one of said components of said second impedance type, said program control signal comprising a bit-parallel code word uniquely designating the assigned note or a portion of the musical scale which includes said note and within which said frequency-dependent circuit operates satisfactorily with said selected impedance value of said second type, and means connecting said code word to said input terminals of said decoding means.

6. An instrument as in claim 5 wherein: said switching means comprises a plurality of switching devices each of which has at least one control electrode responsive to a control signal applied thereto to operate said switching device, said switching devices are effectively connected to couple and decouple said components of said second impedance type operatively to and from said frequency-dependent circuit, and said control electrodes of said switching devices are connected to derive their control signals from respective output terminals of said decoding means.

7. An instrument as in claim 1 wherein said frequency-dependent circuit is a modulating circuit such as a keyer or wave-shaper having an input for connection to a constant or varying voltage, an input-output path, charging means including reactive means shunting said input-output path for charging thereby and conducting means in series between said input voltage and said reactive means whereby said conducting means affects the rate of charging of said reactive means, said charging rate constituting said critical rate which makes said modulating circuit frequency-dependent, and means responsive to a musical tone signal to discharge said reactive means at a rate more rapid than said charging rate so as to periodically discharge said reactive means at the frequency of said musical tone signal, whereby to generate across said reactive means an output modulated at said musical tone signal frequency.

8. An instrument as in claim 7 wherein said conducting means includes a plurality of alternative components of like impedance type but different impedance values, and said programming means comprising switching means responsive to said program control signal to select one of said alternative components to be operatively connected to said modulating circuit.

9. An instrument as in claim 8 wherein said switching means comprises decoding means having input and output terminals, and means connecting said outputs for uniquely selecting one of said alternative components, said program control signal comprising a bit-parallel code word uniquely designating the assigned note or a portion of the musical scale which includes said note and within which said frequency-dependent circuit operates satisfactorily with the impedance value of said selected component, and means connecting said code word to said input terminals of said decoding means.

10. An instrument as in claim 7 wherein said programming means further comprises an adjustable current control device in series with said reactive means to adjust said charging rate, said current control device having a control input terminal, and control means for applying said program control signal to said control input whereby to program said charging rate.

11. An instrument as in claim 10 wherein said control means includes alternative circuit components and is arranged to supply said plurality of alternative control signals by means of respective ones of said alternative circuit components, and switching means including a decoder arranged to select one of said alternative circuit components for operative connection to said control input terminal of said current control device, said program control signal comprising a bit-parallel code word uniquely designating the assigned note or a portion of the musical scale which includes said note, said decoding means having input terminals connected to receive said code word, said program control signal being arranged to match the charging rate thus selected to the requirements of said note or portion of the musical scale.

12. An instrument as in claim 10 wherein said program control signal comprises a bit-serial pulse code having its duty-cycle modulated as a function of the assigned musical note or a portion of the musical scale which contains said note, and said pulse code is applied to said control input terminal to program said charging rate.

13. An instrument as in claim 7 wherein said program control signal comprises a bit-serial pulse code, the duty cycle of which is modulated as a function of the assigned musical note or a portion of the musical scale which contains said note, the repetition rate of said pulse code being higher than the frequency of said musical tone signal, and said programming means comprises means for connecting said pulse code to periodically discharge said reactive means at the repetition rate of said pulse code, and in proportion to said pulse code duty cycle, during the charging intervals of said musical tone signal, whereby to reduce the average charging rate over the time scale of said musical tone signal, the respective pulse code duty cycles being selected to reduce said effective charging rate to the levels required for operation at the frequencies of the corresponding musical notes or portions of the musical scale.

14. An instrument as in claim 1 wherein said frequency-dependent circuit is a modulating circuit such as a keyer or wave-shaper having an input for connection to a constant or varying voltage, an input-output path, a controllable modulating device having an output coupled to said input-output path and arranged so that the effect of said device output tends to counteract the effect of said input voltage on said path, said device having a control input terminal, reactive means arranged to couple a musical tone signal source to said control input terminal whereby to modulate the output of said frequency-dependent circuit at said musical tone frequency, and conducting means connected to discharge said reactive means during alternate half cycles of said musical tone signal, said conducting means and reactive means defining said critical discharging rate which makes said modulating circuit frequency-dependent.

15. An instrument as in claim 14 wherein said controllable modulating device is a transistor, means coupling the collector-emitter path of said transistor to shunt said input-output path, and means coupling the base of said transistor to said reactive means and conducting means.

16. An instrument as in claim 14 wherein said controllable modulating device is a comparator, means coupling the output terminal of said comparator to clamp said input-output path, and means coupling one of the input terminals of said comparator to said input voltage and the other of its input terminals to said reactive means and conducting means.

17. An instrument as in claim 16 wherein said modulating circuit is a wave-shaper, said comparator has one of its input terminals coupled to a constant input voltage, said reactive means couples said musical tone signal to the other of its input terminals, and the output of said wave-shaper being coupled to the output of said comparator, whereby said comparator modulates the output of said wave-shaper at said tone signal frequency.

18. An instrument as in claim 14 wherein said program control signal comprises a bit-serial pulse code, the duty cycle of which is modulated as a function of the assigned musical note or a portion of the musical scale which contains said note, the repetition rate of said pulse code being higher than the frequency of said musical tone signal, said programming means comprising means connecting said pulse code to periodically charge said reactive means at the repetition rate of said pulse code, and in proportion to said pulse code duty cycle, during the discharging intervals of said musical tone signal, whereby to reduce the average value of said critical discharging rate on the time scale of said musical tone signal, said pulse code duty cycle being selected so that the resulting effective discharging rate is at a level required for operation at the corresponding musical frequency or frequencies.

19. An instrument as in claim 14 wherein said programming means comprises means for applying one of a plurality of alternative program inputs to said control input terminal of said modulating device to control said device as a function of the assigned musical note or of a portion of the musical scale which contains said note.

20. An instrument as in claim 19 wherein said programming means includes alternative circuit components, and is arranged to supply said plurality of alternative program inputs by means of respective ones of said alternative circuit components, and switching means including a decoder arranged to select one of said alternative circuit components for operative connection of the appropriate program input to said control input terminal of said modulating device, said program control signal comprising a bit-parallel code word uniquely designating the assigned note or a portion of the musical scale including said note, said decoding means having input terminals connected to receive said code word for control thereby, and said program inputs being arranged to match the discharging rate thus selected to the requirements of said assigned note or portion of the musical scale.

21. An instrument as in claim 14 wherein said conducting means is an adjustable current control device connected to discharge said reactive means at a selected rate, said control device having a control input terminal, and said programming means comprises means for applying said program control signal to said control input terminal whereby to select said discharging rate, said program control signal comprising a bit-serial pulse code the duty cycle of which is modulated as a function of the assigned note or portion of the musical scale containing said note, the repetition rate of said pulse code being higher than the frequency of said musical tone signal, said pulse code driving said current control device to discharge said reactive means periodically at the repetition rate of said pulse code, and in proportion to said pulse code duty cycle, during the charging intervals of said musical tone signal, whereby to reduce the average value of said critical charging rate on the time scale of said musical tone signal, said pulse code duty cycle being selected so that the resulting effective discharging rate is at a level required for operation at the corresponding musical frequency or frequencies.

22. An instrument as in claim 14 wherein said conducting means comprises a plurality of alternative resistors of different values, said programming means including switching means including a decoder arranged for selecting one of said resistors for effective connection to discharge said reactive means, said program control signal comprising a bit-parallel code word uniquely designating the assigned musical note or a portion of the musical scale which includes said note, said decoding means having input terminals connected to receive said code word, said alternative resistor values being chosen so that the selected resistor affects the discharging rate in accordance with the operating requirements imposed by the frequency of the note or portion of the musical scale corresponding to the associated code word.

23. An instrument as in claim 1 wherein said frequency-dependent circuit is a modulating circuit such as a keyer or wave-shaper having an input for connection to a constant or varying voltage, an input-output path, and reactive means, the charging rate of which is said critical charging rate which makes said modulating circuit frequency-dependent, said reactive means being shunted across said input-output path for charging thereby, said programming means further comprising an adjustable current control device in series with said reactive means to adjust said charging rate, said current control device having a control input terminal, and control means for applying one of a plurality of alternative program inputs to said control input terminal whereby to program said charging rate.

24. An instrument as in claim 23 wherein said program control signal comprises a bit-serial pulse code the duty cycle of which is modulated as a function of the assigned note or a portion of the musical scale which contains said note, and said control means is arranged to apply said pulse code to said device control input terminal to program said charging rate.

25. An instrument as in claim 23 wherein said control means includes alternative circuit components, and is arranged to supply said plurality of alternative program inputs by means of respective ones of said alternative circuit components, and switching means including a decoder arranged to select one of said alternative circuit components for operative connection to said control input terminal of said current control device, said program control signal comprising a bit-parallel code word uniquely designating the assigned musical note or a portion of the musical scale which includes said note, said decoder having input terminals connected to receive said code word, said program inputs being arranged to match the charging rate thus selected to the operating requirements imposed by the frequency of said assigned note or portion of the musical scale.

26. An instrument as in claim 1 wherein said frequency-dependent circuit is a modulating circuit such as a keyer or wave-shaper having an input for connection to a constant or varying voltage, an input-output path, first reactive means shunted across said path for charging thereby, a first adjustable current controlling device in series with the charging path of said first reactive means, said first reactive means and first current controlling device defining a first critical charging rate of said frequency-dependent circuit, a controllable modulating device having an output coupled to said input-output path which tends to counteract the effect of said input voltage on said input-output path, said modulating device having a control input terminal, second reactive means arranged to couple a musical tone signal source to said control input terminal whereby to modulate the output of said frequency-dependent circuit at said musical tone frequency, and discharge means comprising a second adjustable current control device connected to discharge said second reactive means during alternate half cycles of said musical tone signal, said second reactive means and second current control device defining a second critical discharge rate of said frequency-dependent circuit, said first and second current control devices having respective control input terminals, said programming means comprising means for applying a plurality of alternative program inputs to each of said current control device control input terminals whereby to program said critical charging and discharging rates of said first and second reactive means respectively as a function of the assigned musical note or a portion of the musical scale containing said note.

27. An instrument as in claim 1 wherein said frequency-dependent circuit is a modulating circuit such as a keyer or wave-shaper having an input for connection to a constant or varying voltage, an input-output path, reactive means included in said input-output path, first and second controllable modulating devices having respective outputs coupled to said input-output path which tend to modify in opposite directions the effect of said input voltage with respect to the charging of said reactive means, the opposed responses of said reactive means to the respective modulating devices comprising critical charging and discharging rates respectively which make said modulating circuit frequency-dependent, said modulating devices having respective control input terminals, means coupling a musical tone signal to the control input terminal of said first modulating device whereby to modulate the output of said frequency-dependent circuit at said musical tone frequency, said programming means comprising means for applying a plurality of alternative program inputs to the control input terminal of said second modulating device whereby to control the degree of discharging effect imposed upon said reactive means by said second modulating device for programming said critical charging rate as a function of the assigned note or a portion of the musical scale containing said note.

28. An instrument as in claim 1 wherein said frequency-dependent circuit is a modulating circuit such as a keyer or wave-shaper having an input for connection to a constant or varying voltage, an input-output path, a controllable modulating device having an output coupled to said input-output path and tending to oppose the effect of said input voltage on said path, said modulating device having a control input terminal, differentiating means coupling a musical tone signal to said control input terminal whereby said device modulates the output of said frequency-dependent circuit at said tone signal frequency, reactive means coupled to said device control input terminal and chargeable by said differentiating means to sustain the effect of said differentiating means on said device, variable means for discharging said reactive means, said reactive means and said discharge means defining said critical discharge rate which makes said modulating circuit frequency-dependent, said programming means being arranged to vary said discharge means whereby to control said discharge rate as a function of the assigned musical note or a portion of the musical scale containing said note.

29. An instrument as in claim 1, further comprising an envelope generator, wherein said frequency-dependent circuit is used for rendering said envelope generator percussive, said circuit comprising threshold-responsive means, and means including a reactor which is coupled to the input of said threshold-responsive means, said reactor being chargeable to delay the turn-on of said threshold-responsive means, the charging rate of said reactor being the critical charging rate which makes said circuit frequency-dependent, said programming means being arranged to charge said reactive means at a rate which is a function of the assigned musical note or a portion of the musical scale containing said note, and means coupling the output of said frequency-dependent circuit to drive said envelope generator.

30. An instrument as in claim 1 wherein said frequency-dependent circuit is an envelope generator responsive to said program control signal to generate an envelope output having an attack phase, said envelope generator comprising reactive means and conducting means for charging or discharging said reactive means during said attack phase, one of said means being variable to adjust the rate of charging or discharging, and output means coupled to derive said envelope output attack phase from the change of voltage across said reactive means during charging or discharging thereof, the rate at which said reactive means is charged or discharged by said conducting means comprising a critical charging or discharging rate which makes said envelope generator frequency-dependent, said programming means being responsive to said program control signal to vary said variable means to adjust said charging or discharging rate whereby to program the duration of said attack phase.

31. An instrument as in claim 30 wherein said variable means comprises a plurality of alternative components of the same impedance type but substantially different impedance values, and switching means responsive to said program control signal for uniquely selecting one of said alternative components for operative connection to charge or discharge said reactive means, said different impedance values resulting in different charging or discharging rates matched to the corresponding musical notes, or portions of the musical scale containing said notes, which are concurrently assigned to said envelope generator by said note assignment means.

32. An instrument as in claim 30 wherein said variable means comprises a switching device arranged for varying the current flowing to or from said reactive means, said switching device having a control input terminal, and said programming means is arranged to apply one of a plurality of alternative program inputs to said control input terminal whereby to produce one of a plurality of alternative current flows to or from said reactive means as a function of the assigned musical note or a portion of the musical scale containing said note.

33. An instrument as in claim 1 wherein said frequency-dependent circuit is an envelope generator responsive to said program control signal to generate an envelope output having a decay phase, said envelope generator comprising reactive means, means for charging or discharging said reactive means during the decay phase of the envelope output, one of said means being variable, the rate at which said reactive means is charged or discharged being a critical charging or discharging rate which makes said envelope generator frequency-dependent, said programming means being arranged to vary said variable means whereby to program the duration of said decay phase.

34. An instrument as in claim 33 wherein said variable means comprises a plurality of alternative components of the same impedance type but substantially different impedance values, and switching means responsive to said program control signal for uniquely selecting one of said alternative components for operative connection to charge or discharge said reactive means, said different impedance values resulting in different charging or discharging rates matched to the corresponding musical notes, or portions of the musical scale containing said notes, which are concurrently assigned to said envelope generator by said note assignment means.

35. An instrument as in claim 33 wherein said variable means comprises a switching device arranged for varying the current flowing to or from said reactive means, said switching device having a control input terminal, and said programming means is responsive to said program control signal to apply one of a plurality of alternative program inputs to said control input terminal whereby to produce one of a plurality of alternative current flows to or from said reactive means as a function of the assigned musical note or a portion of the musical scale containing said note.

36. An instrument as in claim 33 wherein said charging or discharging means comprises first and second paths arranged so that both of said paths charge or discharge said reactive means at the outset of said envelope output decay phase, and snub-level determining means operative, when the envelope voltage decays to a selected snub level, to inactivate one of said discharge paths whereby the charging or discharging rate is slower during the remainder of said decay phase.

37. An instrument as in claim 36 wherein said snub level determining means is variable, and said programming means is arranged to vary said snub level determining means whereby to select said snub level as a function of the assigned note or a portion of the musical scale containing said note.

38. An instrument as in claim 37 wherein said variable snub level determining means comprises a plurality of alternative resistances of substantially different values coupled to a common circuit point, and said programming means comprises switching means connected to provide a current to said common circuit point through one of said alternative resistances, said switching means being responsive to said program control signal to uniquely select, as a function of the assigned musical note or a portion of the musical scale containing said note, which one of said alternative resistances carries said current, whereby to select one of several alternative control voltages for said common point, and means coupling said common point to said reactive means and to said first and second paths, and responsive to the voltage across said reactive means to inactivate one of said two paths when said reactive means voltage reaches the control voltage at said common point.

39. An instrument as in claim 38 wherein said switching means comprises a decoder having input and output terminals, said output terminals being connected to select respective ones of said alternative resistances, said program control signal comprising a bit-parallel code word uniquely designating the assigned note or portion of the musical scale, and connected to apply said code word to said decoder input terminals.

40. An instrument as in claim 37 wherein said variable snub level determining means comprises an analog control device having input and output terminals, said programming means being responsive to said program control signal to select, as a function of the assigned musical note or a portion of the musical scale containing said note, one of a plurality of alternative program inputs and to apply the selected program input to said device input terminal whereby to select one of a plurality of alternative average control voltages at said device output terminal, and means coupling said device output control voltage to said reactive means and to said first and second paths, and responsive to the voltage across said reactive means to inactivate one of said two paths when said reactive means voltage reaches the control voltage at said device output.

41. An instrument as in claim 40 wherein said program inputs comprise a bit-serial code having alternative duty cycles selected as a function of the assigned musical note or portion of the musical scale.

42. An instrument as in claim 36 wherein said programming means comprises respective variable means for programming the charging or discharging rate for each of said paths.

43. An instrument as in claim 42 wherein each of said variable means comprises a plurality of alternative components of the same impedance type but substantially different impedance values, and switching means responsive to said program control signal means for uniquely selecting one of said alternative components for operative connection to charge or discharge said reactive means, said different impedance values resulting in different charging or discharging rates matched to the corresponding musical notes, or portions of the musical scale containing said notes, which are concurrently assigned to said envelope generator by said note assignment means.

44. An instrument as in claim 42 wherein each of said variable means comprises a switching device arranged for varying the current flowing to or from said reactive means, said switching devices having respective control input terminals, and said programming means is responsive to said program control signal to apply one of a plurality of alternative program inputs to both of said device control input terminals whereby to produce one of a plurality of alternative current flows to or from said reactive means as a function of the assigned musical note or a portion of the musical scale containing said note.

45. An instrument as in claim 1 wherein said frequency-dependent circuit comprises filtering means responsive to said tone signal producing means to select the voicing of a musical note, said filtering means comprising charging or discharging means defining said critical charging or discharging rate, said charging or discharging means being variable to change said critical rates whereby to shift the frequency range of said filtering means, and said programming means being responsive to said program control signal to vary said charging or discharging means to shift said filter frequency range to suit the assigned musical note or a portion of the musical scale containing said note.

46. An instrument as in claim 45 wherein said filtering means comprises alternative charging or discharging means having respective alternative charging or discharging rates effective to produce respective alternative filter frequency ranges, and said programming means comprises switching means responsive to said program control signal to select among said alternative means for operative connection to select said filter frequency range, said switching means including a decoder having respective output terminals arranged to switch respective alternative means into such operative connection, said program control signal comprising a bit-parallel code uniquely designating the assigned musical note or a portion of the musical scale containing said note, said decoder having input terminals connected to receive said code whereby to select the alternative means which produces the filter frequency range corresponding to said note or portion of the scale.

47. An instrument as in claim 46 wherein said filter means is a filter circuit and said alternative means comprises at least one set of alternative components having respective different charging or discharging rates whereby to produce respective different filter frequency ranges when operatively connected to said filter circuit, said switching means being arranged to select the appropriate one of said set of alternative components for operative connection thereto to match the filter frequency range to the assigned musical frequency.

48. An instrument as in claim 46 wherein said filtering means comprises a plurality of alternative filter circuits having respective different charging or discharging components whereby to have respective different filter frequency ranges, and said switching means is arranged to select the appropriate one of said filter circuits for operative connection to said tone signal to match the musical frequency thereof.

49. An instrument as in claim 45 wherein said filtering means comprises a filter circuit including said charging or discharging means, at least one variable current control device in series with said charging means whereby to control said charging or discharging current to select said critical rate, said control device having an input terminal, and said program control signal comprising a bit-serial pulse code, the duty cycle of which is modulated as a function of the assigned musical note or a portion of the musical scale containing said note, said control device having a control input terminal, and means connecting said pulse code to said device control input terminal whereby to match said charging or discharging current to the musical frequency.

50. An instrument as in claim 1 wherein said program control signal comprises a bit-serial pulse code, the duty cycle of which is modulated as a function of the assigned musical note or a portion of the musical scale containing said note, and said programming means includes means coupling said pulse code to said critical charging or discharging rate-defining means of said frequency-dependent circuit and effective to make the current through said rate-defining means a function of said pulse code duty cycle whereby said programming means governs said critical rate as a function of musical frequency.

51. An instrument as in claim 50 wherein said rate-defining means is a reactive component, and said coupling means connects said reactive component in series with said pulse code whereby the charging rate of said reactive component is a function of the average current of said pulse code.

52. An instrument as in claim 50 wherein said coupling means is a current control device in series with said critical rate-defining means whereby to govern the current flowing thereto, said control device having a control input terminal, and means coupling said pulse code to said device control input terminal whereby to select said current.

53. An instrument as in claim 50 wherein said note assignment means comprises a program control signal generator including a clock source, a counter responsive to said clock source to produce concurrently on a plurality of separate output lines respective binary digital outputs of increasing numerical digital significance whereby each of said outputs has half the pulse repetition rate but twice the pulse duration as the next preceding less significant output, a decoder responsive to said counter outputs, said decoder having at least one output line for each of several successive octaves in the frequency range of said musical instrument and logic circuitry arranged to rearrange and route said counter outputs to said octave output lines in such manner that each octave output line receives one decoder output pulse within a selected frame time, but the durations of said output pulses on respective output lines representing successive musical octaves increase progressively, whereby said decoder outputs are pulse-duration-modulated relative to each other to achieve the desired duty cycle modulation, and selector means receiving said decoder output lines and responsive to a bit-parallel digital code word input to route a selected one of said decoder outputs to an output of said program control signal generator, said note assignment means comprising means for generating a bit-parallel digital code word uniquely designating the octave which includes the assigned musical note, and applying said octave code to control said selector whereby to select the corresponding octave designation in said bit-serial code.

54. An instrument as in claim 53 wherein said decoder has, in addition to said octave output lines, one or more half octave output lines and additional logic circuitry arranged to rearrange and route said counter outputs to said half octave output lines in such manner that a half octave output appears on each such line, said half octave output having one pulse per frame time but the duration of each such pulse is intermediate between the durations of the pulses which represent integral octaves above and below said half octave, said half octave output lines being included in the inputs processed by said selector, said note assignment means being arranged to include in said bit-parallel code input to said selector sufficient information to designate which half of the assigned octave contains the assigned musical note, said selector being responsive to said information to choose between the integral octave and half octave decoder lines of the assigned octave in selecting said bit-serial code program control signal output.

55. An instrument as in claim 50 wherein said note assignment means comprises a program control signal generator of the type which produces a stream of code output pulses of substantially equal duration, and includes means responsive to said note selection signal for modulating the repetition rate of said code output pulses as a function of the assigned musical note or a portion of the musical scale containing said note, whereby to achieve the desired duty cycle modulation.

56. An instrument as in claim 55 wherein said program control signal generator comprises a pulse code output line, an output flip-flop having an output coupled to said pulse code output line whereby during the set time of said output flip-flop the pulse code output appears on said output line, a digital comparator having two comparison inputs and a comparison detection output coupled to set said output flip-flop whereby to produce a code output pulse for each comparison detection, a counter having an input and an output, a clock connected to drive said counter input, said counter output being connected to one of said comparison inputs, said note assignment means being arranged to present digital octave or octave fraction assignment information to the other comparison input whereby the identity of the selected octave or octave fraction determines the length of time between the start of each counter cycle and the occurrence of the next subsequent comparison detection event which produces a code output pulse, and means responsive to the output of said flip-flop at the time of each code output pulse to reset said counter to zero and rest said flip-flop, whereby to begin determining the time interval between that code output pulse and the next one, and whereby said time interval is a function of said digital information presented by said note assignment means.

57. An instrument as in claim 55 wherein said program control signal generator comprises binary rate multiplier means having a binary rate select input, a clock input, a reset input, and an output which serves as the output of said code generator, a clock source coupled to said clock input, said note assignment means being arranged to present digital octave or octave fraction assignment information to said binary rate select input, and to measure successive frame intervals of a selected length, means responsive to said frame interval measuring means and coupled to said reset input to reset said rate multiplier means once during each frame interval, whereby the output of said rate multiplier means is a stream of substantially equal duration pulses the repetition rate of which within each frame interval is a function of said digital octave or octave fraction assignment input thereto.

58. An instrument as in claim 1 wherein said frequency-dependent circuit is a programmable wave-shaper responsive to said assignment means to produce a musical tone output, said instrument further comprising a plurality of alternative non-programmable signal-combining circuits, the respective alternative envelope-generators for said signal-combining circuits, at least some of which have different musical characteristics, said envelope-generators being responsive to said program control signal to generate respective envelope outputs, said signal-combining circuits being responsive to said wave-shaper and to their respective envelope-generators to combine said musical tone output with the respective envelope outputs, and manual means for selecting among said alternative envelope-generators and alternative signal-combining circuits whereby to select among said different musical characteristics.

59. A modulating circuit such as a keyer or wave-shaper comprising an input for connection to a constant or varying voltage, an input-output path, a comparator having an input coupled to said input voltage and an output coupled to said input-output path and arranged so that the effect of said comparator output tends to counteract the effect of said input voltage on said input-output path, said comparator having a control input terminal, reactive means arranged to couple a musical tone signal source to said control input terminal whereby to modulate the output of said frequency-dependent circuit at said musical tone frequency, and conducting means connected to discharge said reactive means during alternate half cycles of said musical tone signal.

60. In an electronic musical instrument having musical note selection means producing a first control signal for note selection purposes, and circuit means for producing electrical tone signals, said circuit means including at least one circuit which is frequency-dependent by virtue of the fact that it has means defining a critical charging or discharging rate, which critical rate is suitable for operation only over a limited musical frequency range, and note assignment means responsive to said note selection signal to assign said frequency-dependent circuit to participate in the production of a tone signal within a range of musical frequencies exceeding its limited operating range; the improvement wherein: said note assignment means produces a second control signal for programming purposes, and said circuit means includes programming means responsive to said program control signal for adjusting said critical charging or discharging rate to suit the frequency of a selected musical note which is assigned to said frequency-dependent circuit by said note assignment means, said critical charging or discharging rate being defined by component means of first and second impedance types respectively, said component means of at least one of said impedance types being arranged for selective variation of the effective value of the impedance thereof, and said programming means operating by adjusting said variable impedance value to a level which cooperates with the impedance of said component means of said other impedance type to adjust said critical charging or discharging rate to a level such that said frequency-dependent circuit operates satisfactorily at the frequency corresponding to the assigned musical note.

61. An electronic musical instrument having musical note selection means, and circuit means for producing electrical tone signals, said circuit means including at least one modulating circuit which is frequency-dependent by virtue of the fact that it has means defining a critical charging or discharging rate, which critical rate is suitable for operation only over a limited musical frequency range, and note assignment means responsive to said note selection means to assign said modulating circuit to participate in the production of a tone signal within a range of musical frequencies exceeding its limited operating range; wherein the improvement comprises: programming means responsive to said note assignment means for adjusting said critical charging or discharging rate to suit the frequency of a selected musical note which is assigned to said modulating circuit by said note assignment means, said modulating circuit being a keyer or wave-shaper having an input for connection to a constant or varying voltage, an input-output path, charging means including reactive means shunting said input-output path for charging thereby and conducting means in series between said input voltage and said reactive means whereby said conducting means affects the rate of charging of said reactive means, said charging rate constituting said critical rate which makes said modulating circuit frequency-dependent, and means responsive to a musical tone signal to discharge said reactive means at a rate more rapid than said charging rate so as to periodically discharge said reactive means at the frequency of said musical tone signal, whereby to generate across said reactive means an output modulated at said musical tone signal frequency.

62. An electronic musical instrument having musical note selection means, and circuit means for producing electrical tone signals, said circuit means including at least one modulating circuit which is frequency-dependent by virtue of the fact that it has means defining a critical charging or discharging rate, which critical rate is suitable for operation only over a limited musical frequency range, and note assignment means responsive to said note selection means to assign said modulating circuit to participate in the production of a tone signal within a range of musical frequencies exceeding its limited operating range; wherein the improvement comprises: programming means responsive to said note assignment means for adjusting said critical charging or discharging rate to suit the frequency of a selected musical note which is assigned to said modulating circuit by said note assignment means, said modulating means being a keyer or wave-shaper having an input for connection to a constant or varying voltage, an input-output path, a controllable modulating device having an output coupled to said input-output path and arranged so that the effect of said device output tends to counteract the effect of said input voltage on said path, said device having a control input terminal, reactive means arranged to couple a musical tone signal source to said control input terminal whereby to modulate the output of said frequency-dependent circuit at said musical tone frequency, and conducting means connected to discharge said reactive means during alternate half cycles of said musical tone signal, said conducting means and reactive means defining said critical discharging rate which makes said modulating circuit frequency-dependent.

63. An electronic musical instrument having musical note selection means, and circuit means for producing electrical tone signals, said circuit means including at least one modulating circuit which is frequency-dependent by virtue of the fact that it has means defining a critical charging or discharging rate, which critical rate is suitable for operation only over a limited musical frequency range, and note assignment means responsive to said note selection means to assign said modulating circuit to participate in the production of a tone signal within a range of musical frequencies exceeding its limited operating range; wherein the improvement comprises: programming means responsive to said note assignment means for adjusting said critical charging or discharging rate to suit the frequency of a selected musical note which is assigned to said modulating circuit by said note assignment means, said modulating circuit being a keyer or wave-shaper having an input for connection to a constant or varying voltage, an input-output path, and reactive means, the charging rate of which is said critical charging rate which makes said modulating circuit frequency-dependent, said reactive means being shunted across said input-output path for charging thereby, said programming means further comprising an adjustable current control device in series with said reactive means to adjust said charging rate, said current control device having a control input terminal, and control means for applying one of a plurality of alternative control signals to said control input terminal whereby to program said charging rate.

64. An electronic musical instrument having musical note selection means, and circuit means for producing electrical tone signals, said circuit means including at least one modulating circuit which is frequency-dependent by virtue of the fact that it has means defining a critical charging or discharging rate, which critical rate is suitable for operation not only over a limited musical frequency range, and note assignment means responsive to said note selection means to assign said modulating circuit to participate in the production of a tone signal within a range of musical frequencies exceeding its limited operating range; wherein the improvement comprises: programming means responsive to said note assignment means for adjusting said critical charging or discharging rate to suit the frequency of a selected musical note which is assigned to said modulating circuit by said note assignment means, said modulating circuit being a keyer or wave-shaper having an input for connection to a constant or varying voltage, an input-output path, first reactive means shunted across said path for charging thereby, a first adjustable current controlling device in series with the charging path of said first reactive means, said first reactive means and first current controlling device defining a first critical charging rate of said frequency-dependent circuit, a controllable modulating device having an output coupled to said input-output path which tends to counteract the effect of said input voltage on said input-output path, said modulating device having a control input terminal, second reactive means arranged to couple a musical tone signal source to said control input terminal whereby to modulate the output of said frequency-dependent circuit at said musical tone frequency, and discharge means comprising a second adjustable current control device connected to discharge said second reactive means during alternate half cycles of said musical tone signal, said second reactive means and second current control device defining a second critical discharge rate of said frequency-dependent circuit, said first and second current control devices having respective control input terminals, said programming means comprising means for applying a plurality of alternative control signals to each of said current control device control input terminals whereby to program said critical charging and discharging rates of said first and second reactive means respectively as a function of the assigned musical note or a portion of the musical scale containing said note.

65. An electronic musical instrument having musical note selection means, and circuit means for producing electrical tone signals, said circuit means including at least one modulating circuit which is frequency-dependent by virtue of the fact that it has means defining a critical charging or discharging rate, which critical rate is suitable for operation only over a limited musical frequency range, and note assignment means responsive to said note selection means to assign said modulating circuit to participate in the production of a tone signal within a range of musical frequencies exceeding its limited operating range; wherein the improvement comprises: programming means responsive to said note assignment means for adjusting said critical charging or discharging rate to suit the frequency of a selected musical note which is assigned to said modulating circuit by said note assignment means, said modulating circuit being a keyer or wave-shaper having an input for connection to a constant or varying voltage, an input-output path, reactive means included in said input-output path, first and second controllable modulating devices having respective outputs coupled to said input-output path which tend to modify in opposite directions the effect of said input voltage with respect to the charging of said reactive means, the opposed responses of said reactive means to the respective modulating devices comprising critical charging and discharging rates respectively which make said modulating circuit frequency-dependent, said modulating devices having respective control input terminals, means coupling a musical tone signal to the control input terminal of said first modulating device whereby to modulate the output of said frequency-dependent circuit at said musical tone frequency, said programming means comprising means for applying a plurality of alternative control signals to the control input terminal of said second modulating device whereby to control the degree of discharging effect imposed upon said reactive means by said second modulating device for programming said critical charging rate as a function of the assigned note or a portion of the musical scale containing said note.

66. An electronic musical instrument having musical note selection means, and circuit means for producing electrical tone signals, said circuit means including at least one modulating circuit which is frequency-dependent by virtue of the fact that it has means defining a critical charging or discharging rate, which critical rate is suitable for operation only over a limited musical frequency range, and note assignment means responsive to said note selection means to assign said modulating circuit to participate in the production of a tone signal within a range of musical frequencies exceeding its limited operating range; wherein the improvement comprises: programming means responsive to said note assignment means for adjusting said critical charging or discharging rate to suit the frequency of a selected musical note which is assigned to said modulating circuit by said note assignment means, said modulating circuit being a keyer or wave-shaper having an input for connection to a constant or varying voltage, an input-output path, a controllable modulating device having an output coupled to said input-output path and tending to oppose the effect of said input voltage on said path, said modulating device having a control input terminal, differentiating means coupling a musical tone signal to said control input terminal whereby said device modulates the output of said frequency-dependent circuit at said tone signal frequency, reactive means coupled to said device control input terminal and chargeable by said differentiating means to sustain the effect of said differentiating means on said device, variable means for discharging said reactive means, said reactive means and said discharge means defining said critical discharge rate which makes said modulating circuit frequency-dependent, said programming means being arranged to vary said discharge means whereby to control said discharge rate as a function of the assigned musical note or a portion of the musical scale containing said note.

67. An electronic musical instrument having musical note selection means, and circuit means for producing electrical tone signals, said circuit means including an envelope generator and at least one circuit which is frequency-dependent by virtue of the fact that it has means defining a critical charging or discharging rate, which critical rate is suitable for operation only over a limited musical frequency range, and note assignment means responsive to said note selection means to assign said frequency-dependent circuit to participate in the production of a tone signal within a range of musical frequencies exceeding its limited operating range; wherein the improvement comprises: programming means responsive to said note assignment means for adjusting said critical charging or discharging rate to suit the frequency of a selected musical note which is assigned to said frequency-dependent circuit by said note assignment means, said frequency-dependent circuit being used for rendering said envelope generator percussive, said circuit comprising threshold-responsive means, and means including a reactor which is coupled to the input of said threshold-responsive means, said reactor being chargeable to delay the turn-on of said threshold-responsive means, the charging rate of said reactor being the critical charging rate which makes said circuit frequency-dependent, said programming means being arranged to charge said reactive means at a rate which is a function of the assigned musical note or a portion of the musical scale containing said note, and means coupling the output of said frequency-dependent circuit to drive said envelope generator.

68. An electronic musical instrument having musical note selection means, and circuit means for producing electrical tone signals, said circuit means including at least one envelope generator circuit which is frequency-dependent by virtue of the fact that it has means defining a critical charging or discharging rate, which critical rate is suitable for operation only over a limited musical frequency range, and note assignment means responsive to said note selection means to assign said envelope generator to participate in the production of a tone signal within a range of musical frequencies exceeding its limited operating range; wherein the improvement comprises: programming means responsive to said note assignment means for adjusting said critical charging or discharging rate to suit the frequency of a selected musical note which is assigned to said envelope generator by said note assignment means, said envelope generator being responsive to said assignment means to generate an envelope output having an attack phase, said envelope generator comprising reactive means and conducting means for charging or discharging said reactive means during said attack phase, one of said means being variable to adjust the rate of charging or discharging, and output means coupled to derive said envelope output attack phase from the change of voltage across said reactive means during charging or discharging thereof, the rate at which said reactive means is charged or discharged by said conducting means comprising a critical charging or discharging rate which makes said envelope generator frequency-dependent, said programming means being responsive to said assignment means to vary said variable means to adjust said charging or discharging rate whereby to program the duration of said attack phase.

69. An electronic musical instrument having musical note selection means, and circuit means for producing electrical tone signals, said circuit means including at least one envelope generator circuit which is frequency-dependent by virtue of the fact that it has means defining a critical charging or discharging rate, which critical rate is suitable for operation only over a limited musical frequency range, and note assignment means responsive to said note selection means to assign said envelope generator to participate in the production of a tone signal within a range of musical frequencies exceeding its limited operating range; wherein the improvement comprises: programming means responsive to said note assignment means for adjusting said critical charging or discharging rate to suit the frequency of a selected musical note which is assigned to said envelope generator by said note assignment means, said envelope generator being responsive to said note assignment means to generate an envelope output having a decay phase, said envelope generator comprising reactive means, means for charging or discharging said reactive means during the decay phase of the envelope output, one of said means being variable, the rate at which said reactive means is charged or discharged being a critical charging or discharging rate which makes said envelope generator frequency-dependent, said programming means being arranged to vary said variable means whereby to program the duration of said decay phase.

70. In an electronic musical instrument having musical note selection means producing a first control signal for note selection purposes, and circuit means for producing electrical tone signals, said circuit means including filtering means which is frequency-dependent by virtue of the fact that it has means defining a critical charging or discharging rate, which critical rate is suitable for operation only over a limited musical frequency range, and note assignment means responsive to said note selection signal to assign said filtering means to participate in the production of a tone signal within a range of musical frequencies exceeding its limited operating range; the improvement wherein: said note assignment means produces a second control signal for programming purposes, and said circuit means includes programming means responsive to said program control signal for adjusting said critical charging or discharging rate to suit the frequency of a selected musical note which is assigned to said filtering means by said note assignment means, said filtering means being responsive to said tone signal producing means to select the voicing of a musical note, said filtering means comprising charging or discharging means defining said critical charging or discharging rate, said charging or discharging means being variable to change said critical rates whereby to shift the frequency range of said filtering means, and said programming means being responsive to said program control signal to vary said charging or discharging means to shift said filter frequency range to suit the assigned musical note or a portion of the musical scale containing said note.

71. An electronic musical instrument having musical note selection means, and circuit means for producing electrical tone signals, said circuit means including at least one circuit which is frequency-dependent by virtue of the fact that it has means defining a critical charging or discharging rate, which critical rate is suitable for operation only over a limited musical frequency range, and note assignment means responsive to said note selection means to assign said frequency-dependent circuit to participate in the production of a tone signal within a range of musical frequencies exceeding its limited operating range; wherein the improvement comprises: programming means responsive to said note assignment means for adjusting said critical charging or discharging rate to suit the frequency of a selected musical note which is assigned to said frequency-dependent circuit by said note assignment means, said note assignment means producing a bit-serial pulse code, the duty cycle of which is modulated as a function of the assigned musical note or a portion of the musical scale containing said note, and said programming means includes means coupling said pulse code to said critical charging or discharging rate-defining means of said frequency-dependent circuit and effective to make the current through said rate-defining means a function of said pulse code duty cycle whereby said programming means governs said critical rate as a function of musical frequency.

72. An electronic musical instrument having musical note selection means, and circuit means for producing electrical tone signals, said circuit means including at least one wave-shaper circuit which is frequency-dependent by virtue of the fact that it has means defining a critical charging or discharging rate, which critical rate is suitable for operation only over a limited musical frequency range, and note assignment means responsive to said note selection means to assign said wave-shaper to participate in the production of a tone signal within a range of musical frequencies exceeding its limited operating range; wherein the improvement comprises: programming means responsive to said note assignment means for adjusting said critical charging or discharging rate to suit the frequency of a selected musical note which is assigned to said wave-shaper by said note assignment means, said wave-shaper being responsive to said assignment means to produce a musical tone output, said instrument further comprising a plurality of alternative non-programmable signal-combining circuits, and respective alternative envelope-generators for said signal-combining circuits, at least some of which have different musical characteristics, said envelope-generators being responsive to said assignment means to generate respective envelope outputs, said signal-combining circuits being responsive to said wave-shaper and to their respective envelope-generators to combine said musical tone output with the respective envelope outputs, and manual means for selecting among said alternative envelope-generators and alternative signal-combining circuits whereby to select among said different musical characteristics.

* * * * *